US006729779B2

(12) United States Patent
Piccinino, Jr. et al.

(10) Patent No.: US 6,729,779 B2
(45) Date of Patent: May 4, 2004

(54) PHOTOGRAPHIC PROCESSING DRUM HAVING A METERING BLADE ASSEMBLY

(75) Inventors: Ralph L. Piccinino, Jr., Rush, NY (US); Jeffrey L. Hall, Rochester, NY (US); Faye Transvalidou, Rochester, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 108 days.

(21) Appl. No.: 10/241,359

(22) Filed: Sep. 11, 2002

(65) Prior Publication Data

US 2004/0047627 A1 Mar. 11, 2004

(51) Int. Cl.[7] ..... G03D 3/02; G03D 3/04
(52) U.S. Cl. ..... 396/626; 396/634
(58) Field of Search ..... 396/626, 633, 396/634, 635, 636; 355/27–29, 40, 41

(56) References Cited

U.S. PATENT DOCUMENTS

| | | | |
|---|---|---|---|
| 3,792,651 | A | 2/1974 | Banks |
| 4,005,463 | A | 1/1977 | Kowalski |
| 4,178,088 | A | 12/1979 | Harding |
| 4,269,501 | A | 5/1981 | Griffith et al. |
| 4,431,294 | A | 2/1984 | Baker |

*Primary Examiner*—D Rutledge
(74) *Attorney, Agent, or Firm*—David A. Novais

(57) ABSTRACT

The present invention relates to a photographic processor which includes a circular processing drum and a metering blade assembly provided within the drum. The metering blade assembly is adapted to control or meter an amount of processing solution provided on film to be processed in the film path. The metering blade assembly is adjustable so as to accommodate 35 mm or APS film in the photographic processor. The metering blade assembly is also attached to a support assembly or member which further supports an agitating roller. With the arrangement of the present invention, it is possible to adjust the width of both the agitating roller and the metering blade in accordance with the type of film to be processed in the photographic processor.

17 Claims, 27 Drawing Sheets

PHOTOGRAPHIC PROCESSING DRUM HAVING A METERING BLADE ASSEMBLY

CROSS REFERENCE TO RELATED APPLICATIONS

The present application is related to the following pending patent applications: U.S. patent application Ser. No. 10/027,382 filed Dec. 21, 2001, entitled PHOTOGRAPHIC PROCESSOR AND METHOD OF OPERATION; U.S. patent application Ser. No. 10/027,454 filed Dec. 21, 2001, entitled A PROCESSING SOLUTION DELIVERY SYSTEM HAVING A SUPPLY TUBE AND LEVEL DETECTION SENSOR UNIT FOR USE WITH A PHOTOGRAPHIC PROCESSOR; U.S. patent application Ser. No. 10/027,381 filed Dec. 21, 2001, entitled PHOTOGRAPHIC PROCESSOR HAVING AN ADJUSTABLE DRUM; U.S. patent application Ser. No. 10/027,432 filed Dec. 21, 2001, entitled CHEMICAL DELIVERY SYSTEM FOR USE WITH A PHOTOGRAPHIC PROCESSOR AND METHOD OF OPERATION; U.S. patent application Ser. No. 10/108,141 filed Mar. 27, 2002, entitled PHOTOGRAPHIC PROCESSOR HAVING SIDE BY SIDE PROCESSING PATHS AND METHOD OF OPERATION U.S. patent application Ser. No. 10/164,067 filed Jun. 5, 2002 entitled PROCESSING SOLUTION DELIVERY SYSTEM FOR USE WITH A PHOTOGAPHIC PROCESSOR AND METHOD OF OPERATION; U.S. patent application Ser. No. 10/185,185 filed Jun. 28, 2002 entitled THERMAL MANAGEMENT DRUM FOR A PHOTOGRAPHIC PROCESSOR; U.S. patent application Ser. No. 10/218,807 filed Aug. 14, 2002, entitled ULTRASONIC CLEANING IN BATCH PHOTO-PROCESSING EQUIPMENT and U.S. patent application Ser. No. 10/242,124, filed Sep. 12, 2002, entitled PHOTOGRAPHIC PROCESSOR HAVING A WASHING ASSEMBLY.

FIELD OF THE INVENTION

The present invention is directed to a photographic processing drum having a metering blade assembly and a method of operation.

BACKGROUND OF THE INVENTION

Photographic processors come in a variety of shapes and sizes from large wholesale photographic processors to small micro-labs. As photographic processors become more and more technologically sophisticated, there is a continued need to make the photographic processor as user-friendly and as maintenance-free as possible.

Currently available photographic processors have one or more of the following shortcomings: (1) the film processing time is relatively long; (2) some photographic processors, because of their size, require a large amount of space; (3) some photographic processors may require an unacceptable amount of processing solution due to the design of the processing tank; and (4) some photographic processors generate an unacceptable amount of solution waste due to the design of the processing tank.

What is needed in the art is a photographic processor, which provides exceptional print quality while requiring a minimal number of tasks necessary for an operator to process a roll of film. What is also needed in the art is a photographic processor which is designed to maintain processing solution within a specified zone or area of the processor and minimize the circulation of solution outside of the specified zone or area.

SUMMARY OF THE INVENTION

The present invention addresses some of the difficulties and problems discussed above by the discovery of a photographic processor having an internal drum design, which minimizes the chemicals required to process a roll of film and consequently minimizes the amount of waste generated per roll of film processing. The photographic processor is extremely user-friendly and low maintenance.

The present invention accordingly provides for a photographic processor which comprises a circular processing drum for processing photographic film, with an inside surface of a perimeter of the drum defining a film path for film to be processed; a support assembly provided within the circular processing drum; and a metering blade assembly supported by the support assembly. The metering blade assembly extends from the support assembly toward a first location within the drum adjacent to the inside surface of the drum. The metering blade assembly is adapted to at least control an amount of processing solution provided on film to be processed in the film path.

The present invention further provides for a photographic processor which comprises a circular processing drum for processing photographic film, with an inside surface of a perimeter of the drum defining a film path for film to be processed; support means provided in the processing drum; and metering means for metering processing solution on the film to be processed. The metering means is supported by the support means.

The present invention further provides for a method of processing photographic film which comprises inserting film into a film path in a circular processing drum having processing solution therein, with the film path extending along an inside surface of the perimeter of the drum; and providing a metering blade along the film path to control an amount of processing solution on the film and prevent excess solution from circulating within the processing drum toward an area downstream of the metering blade with respect to the direction of travel of the film.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

Figure 1:
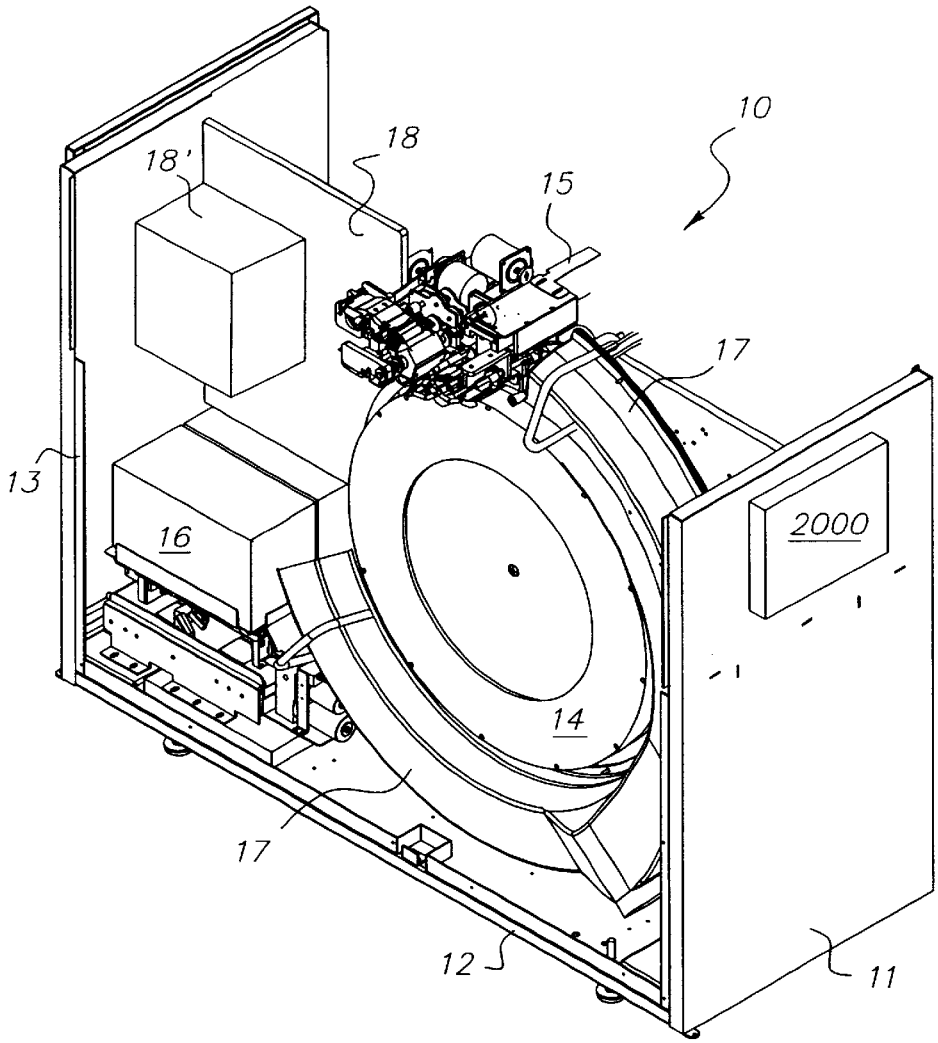
FIG. 1 is a frontal view of an exemplary photographic processor of the present invention.

An exemplary photographic processor is shown in FIG. 1. Photographic processor 10 comprises at least an outer housing, which includes a first side wall 11, a base housing member 12, and a second side wall 13. Photographic processor 10 includes a circular processing chamber or drum 14 (also referred to herein as the "circular processing drum 14"), which may be used to expose a given strip or roll of film to one or more photoprocessing chemicals. Photographic processor 10 further includes a film-loading/unloading device 15 positioned above and cooperating with circular processing drum 14. A chemical delivery system 16 is positioned for easy access by a user (i.e., for maintenance or replacement purposes) at a location near side wall 13 and base housing member 12. Photographic processor 10 also includes a circular dryer 17 in the form of, for example, a cylinder, for drying the processed film. Dryer 17 is concentrically and co-axially positioned around processing drum 14. Once a given strip or roll of film is dried in dryer 17, the film proceeds to a scanner 18', which maybe positioned above chemical delivery system 16 in a space bordered by side wall 13 and left interior wall 18 or any other convenient location.

Figure 2:
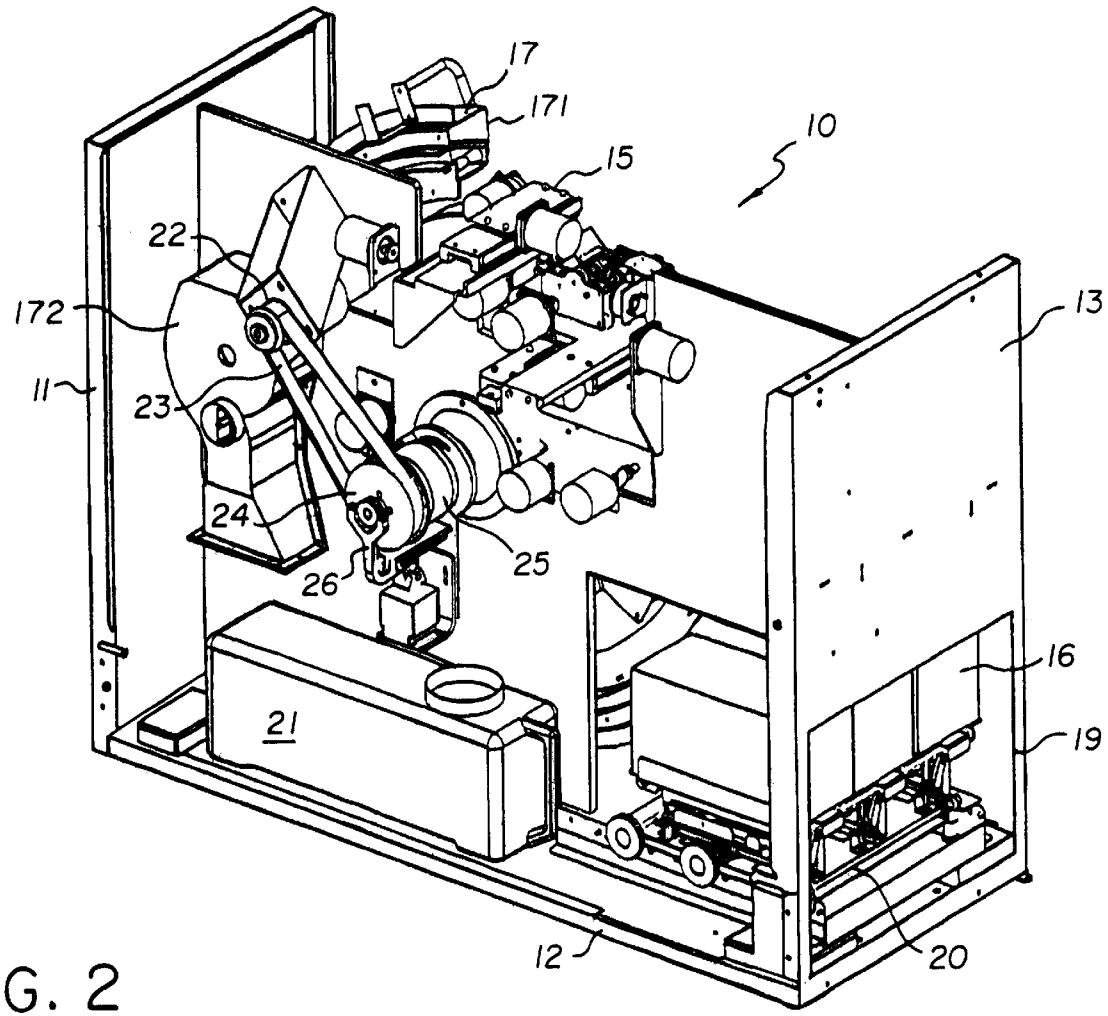
FIG. 2 is a rear view of an exemplary photographic processor of the present invention.

FIG. 2 depicts a rear view of photographic processor 10. As shown in FIG. 2, photographic processor 10 includes opening 19 in side wall 13 for accessing chemical delivery system 16. Sliding track mechanism 20 allows an operator to pull at least a portion of chemical delivery system 16 through opening 19 to an exterior location outside of photographic processor 10. Such an assembly allows for quick and easy maintenance and replacement of chemical delivery system 16. Photographic processor 10 can include a waste collection reservoir 21, which collects and stores used processing chemicals removed from circular processing drum 14 following development of a given strip or roll of film. As shown in FIG. 2, dryer 17 includes dryer entrance 171 and dryer blower 172. The various components of photographic processor 10 will be described in more detail below with reference to FIGS. 3–21.

Figure 3:
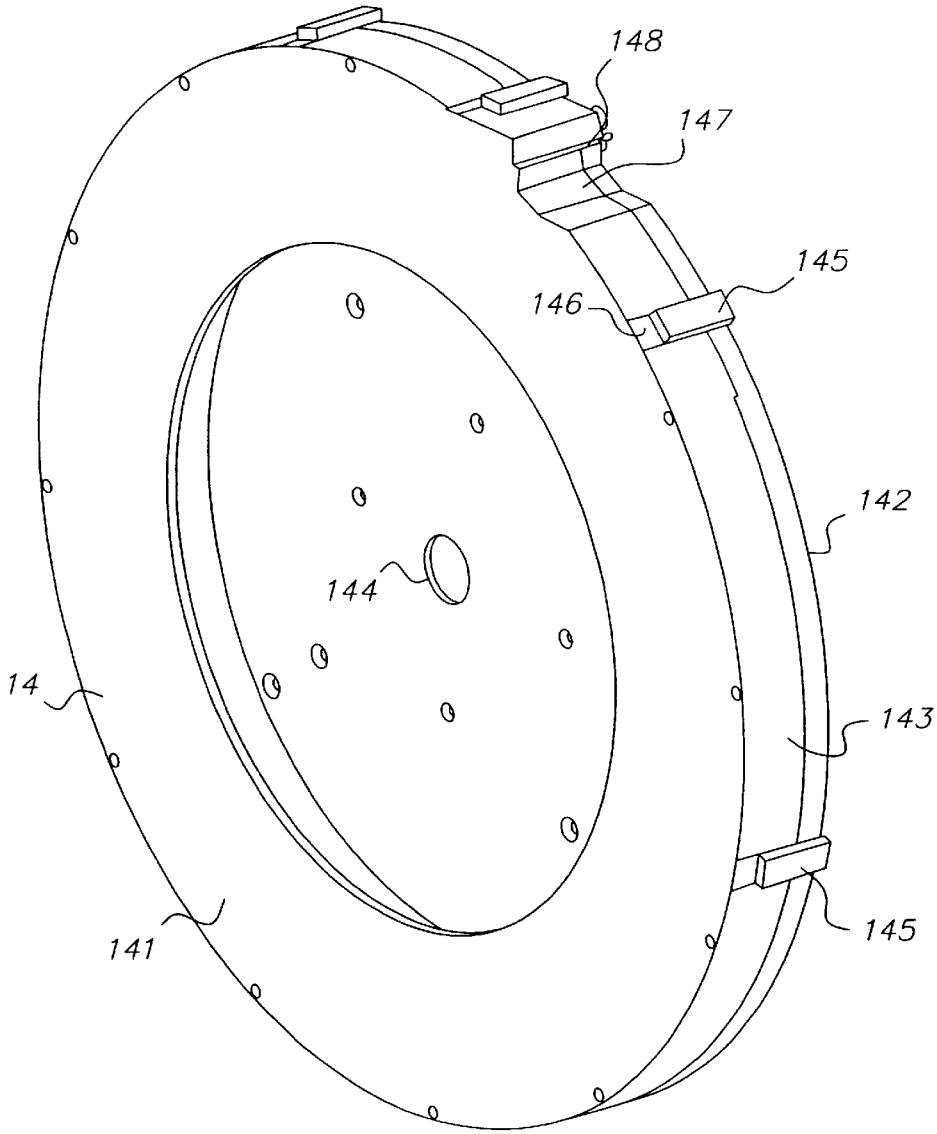
FIG. 3 depicts an exemplary circular processing drum used in the photographic processor of the present invention.

Circular processing drum 14 is further described in FIG. 3. As shown in FIG. 3, circular processing drum 14 includes a first or front wall 141, a second or back wall 142, a side wall 143, and a central axis opening 144. A portion of a drum and disk drive mechanism 25 (shown in FIGS. 2, 8 and 9) passes through central access opening 144. Circular processing drum 14 comprises two circular sections joined together at multiple locations around the perimeter of circular processing drum 14 via male clasping members 145 and female clasping members 146. It should be noted that any means for attaching the two circular components of circular processing drum 14 may be used in place of male clasping members 145 and female clasping members 146. Further, it should be noted that circular processing drum 14 may also be in the form of a single component as oppose to two circular components as shown in FIG. 3, although such a design may add manufacturing cost to circular processing drum 14.

Circular processing drum 14 further comprises a film cartridge loading area 147 on an outer surface of side wall 143 for loading film directly from a film cartridge into circular processing drum 14, such as with APS film. Circular processing drum 14 also comprises a film input slot 148, which enables the entry and exit of film into circular processing drum 14.

Figure 4:
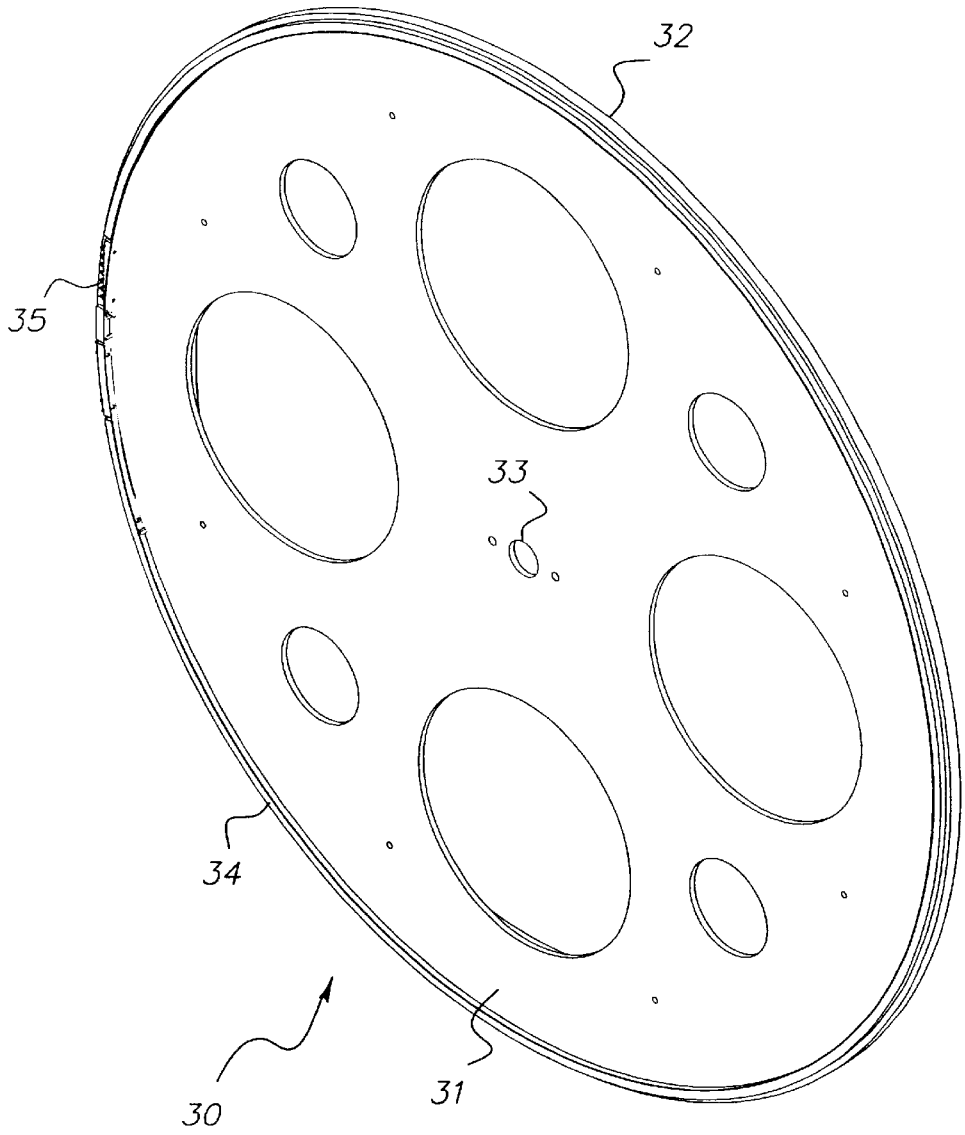
FIG. 4 depicts an exemplary disk located within the circular processing drum of the present invention.
Figure 5:
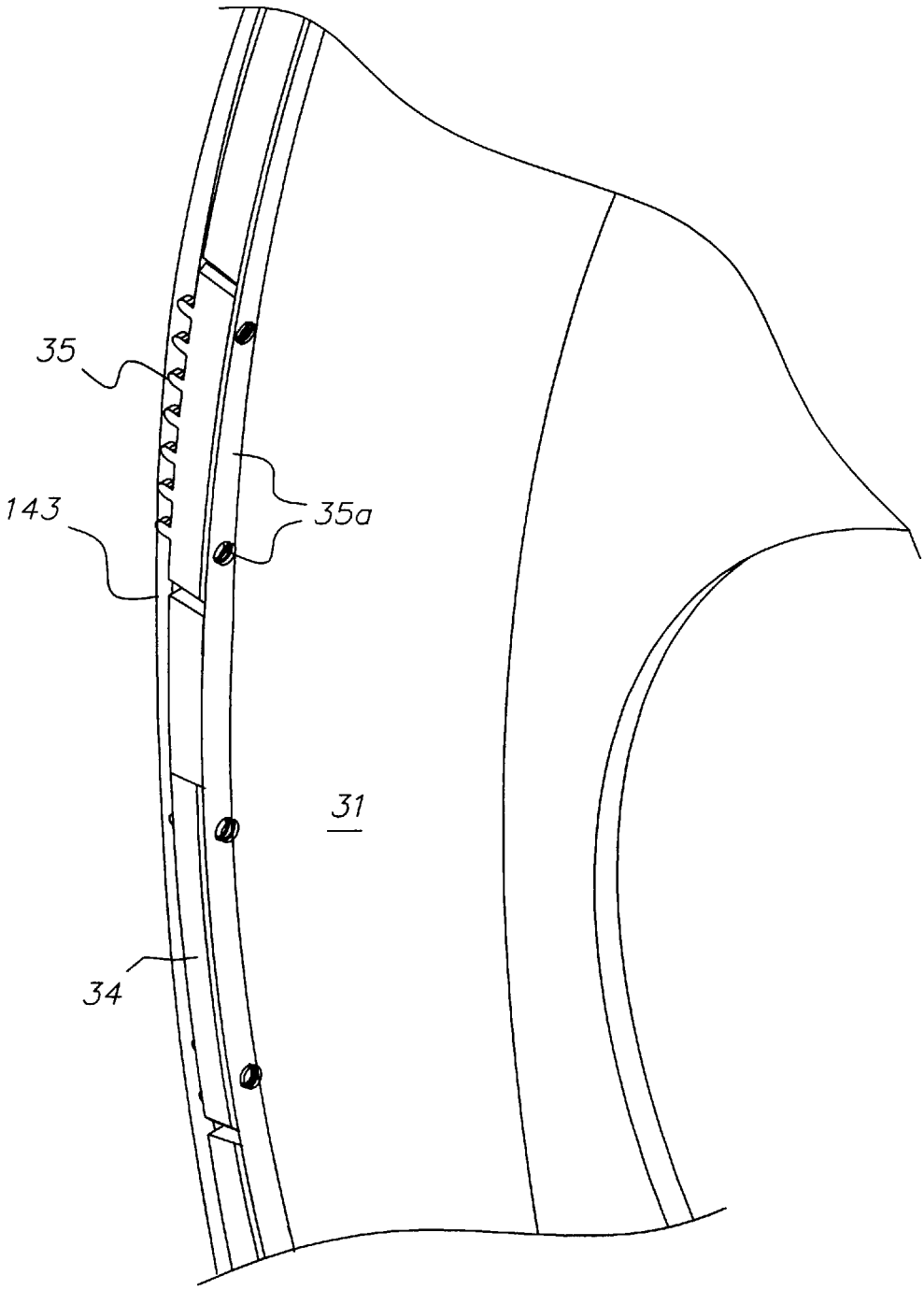
FIG. 5 displays a close-up view of an exemplary disk having an outer perimeter and one or more sets of disk teeth.
Figure 6:
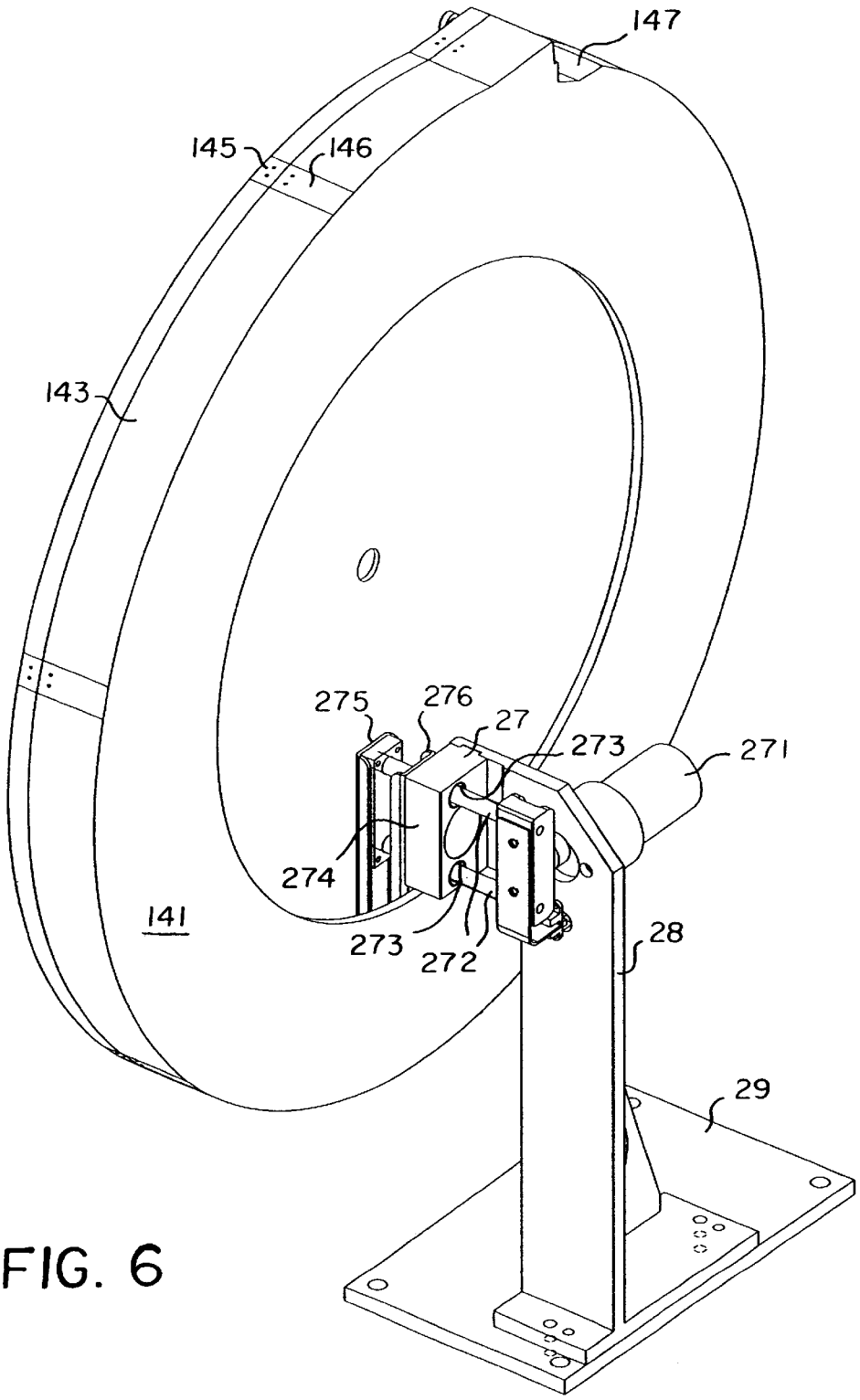
FIG. 6 depicts an exemplary roller mechanism positioned within the circular processing drum.

FIG. 4 depicts an exemplary disk 30, which is positioned within circular processing drum 14, and functions to convey film within circular processing drum 14 once the film enters through film input slot 148. Disk 30 includes a first face 31, a second face 32, a central access opening 33, an outer perimeter 34, and one or more sets of disk teeth 35 located along outer perimeter 34 of disk 30. As with circular processing drum 14, a portion of drum and disk drive mechanism 25 may extend into central access opening 33 to engage with and cause rotation of disk 30. FIG. 5 provides a close-up view of a portion of disk 30, and in particular, outer perimeter 34 and a set of disk teeth 35 on the outer perimeter 34 of disk 30. The outermost points of disk teeth 35 are in close proximity to an inner surface of side wall 143 of circular processing drum 14. In a feature of the invention, disk teeth 35 could be spring loaded through the use of spring arrangement 35*a*.

Figure 7:
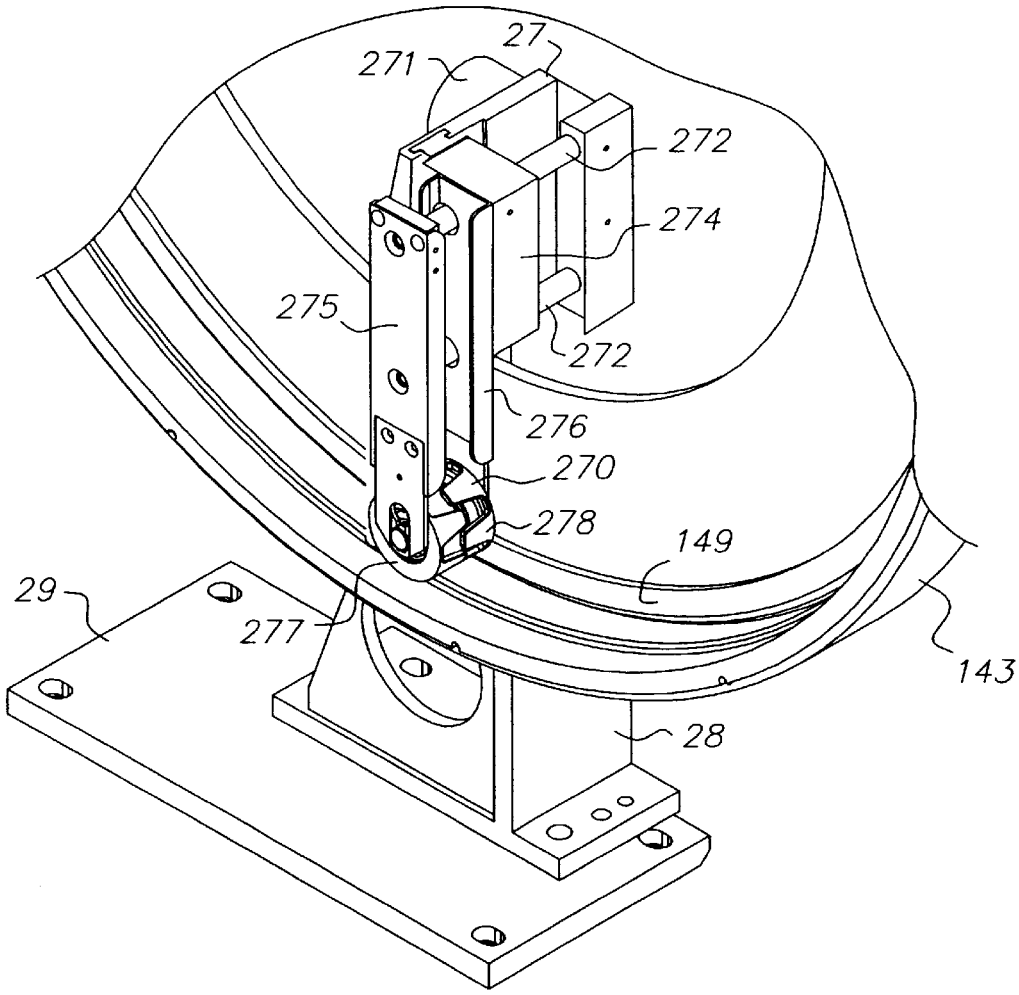
FIG. 7 depicts a rear view of the exemplary roller mechanism of FIG. 6.

A roller arrangement 27 (FIGS. 6 and 7) is positioned within circular processing drum 14. Roller arrangement 27 includes a roller 270 having interengaging members 277 and 278 (FIG. 7). Roller arrangement 27 may be supported by a support member 28, which is attached to a support member base 29. Support member base 29 may be permanently or temporarily attached to base housing member 12 (shown in FIGS. 1 and 2). Roller arrangement 27 includes a motor 271, which provides motion to pistons 272 through openings 273 in a fixed positioning member 274. Pistons 272 proceed through stationary positioning support member 276 and are attached to movable positioning support member 275. As pistons 272 move, movable positioning support member 275 which is coupled to member 277 separates from stationary positioning support member 276 which is coupled to member 278. This permits roller 270 to be expandable between a first width when the members 277 and 278 overlap each other and a second width larger than the first width (FIG. 7) when the members 277 and 278 move away from each other.

FIG. 7 provides a detailed view of roller arrangement 27 and its various components. As shown in FIG. 7, movable positioning support member 275 and stationary positioning support member 276 connect to interengaging members 277 and 278 respectively as described above. During use, the film passes between roller 270 and an interior surface of drum 14. Roller 270 is freely rotatable and maintains the film flat along the lower portion of drum 14. As will be described later, roller 270 further provides an agitating feature within processing drum 14 during processing. Additionally, the width of roller 270 is adjustable as described above to accommodate a shorter width film (i.e. APS film) and a larger width film (i.e. 35 mm film). Further, roller arrangement 27 including roller 270 can be vertically adjustable to accommodate for film curl as the film passes between roller 270 and the interior surface of drum 14. As a still further option, roller 270 can be spring loaded so as to accommodate any variation in the interior surface of drum 14.

Figure 8:
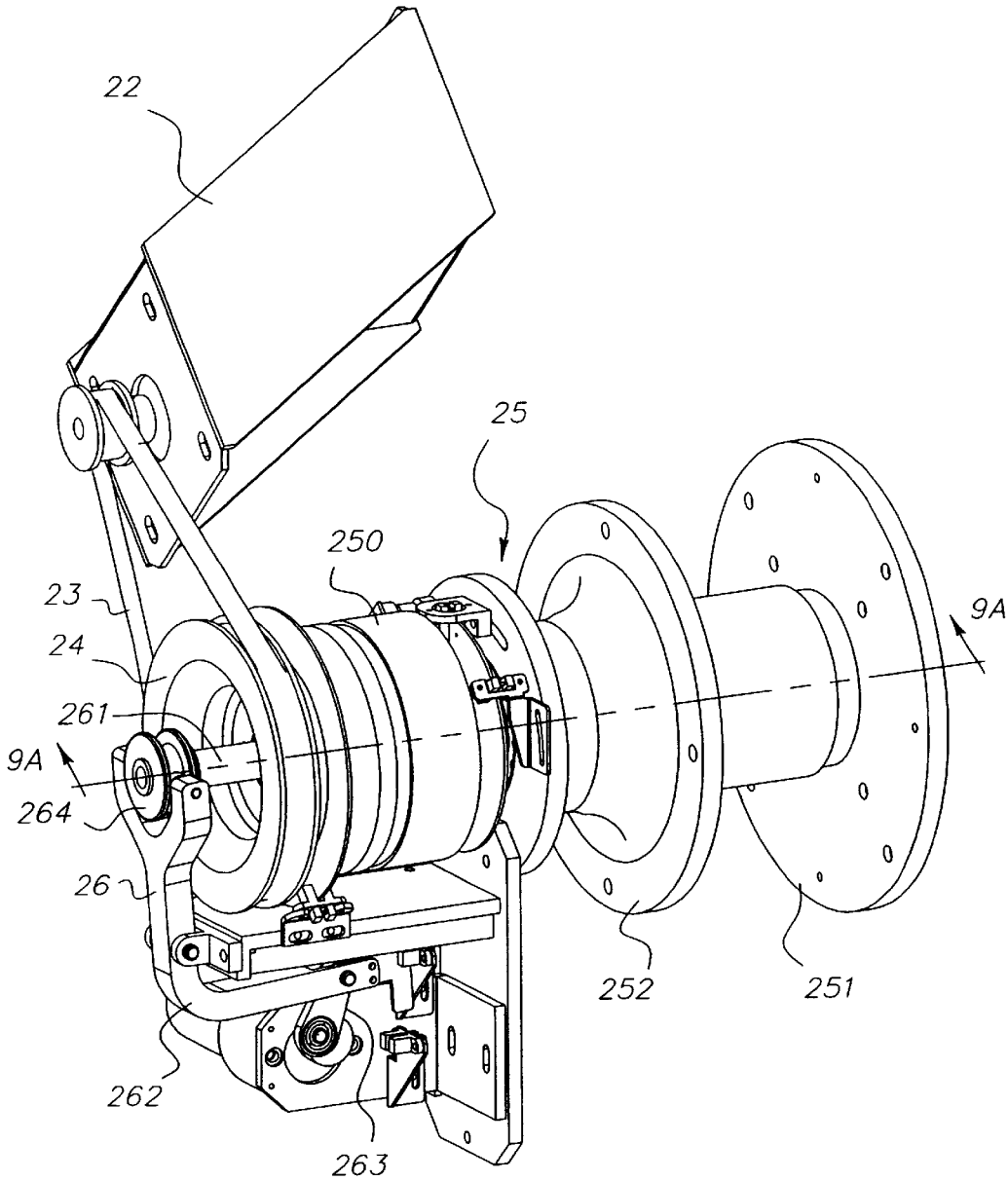
FIG. 8 depicts an exemplary drum and disk drive mechanism for rotating a circular processing drum, and a clutch mechanism for selectively engaging the drum and disk.
Figure 9A:
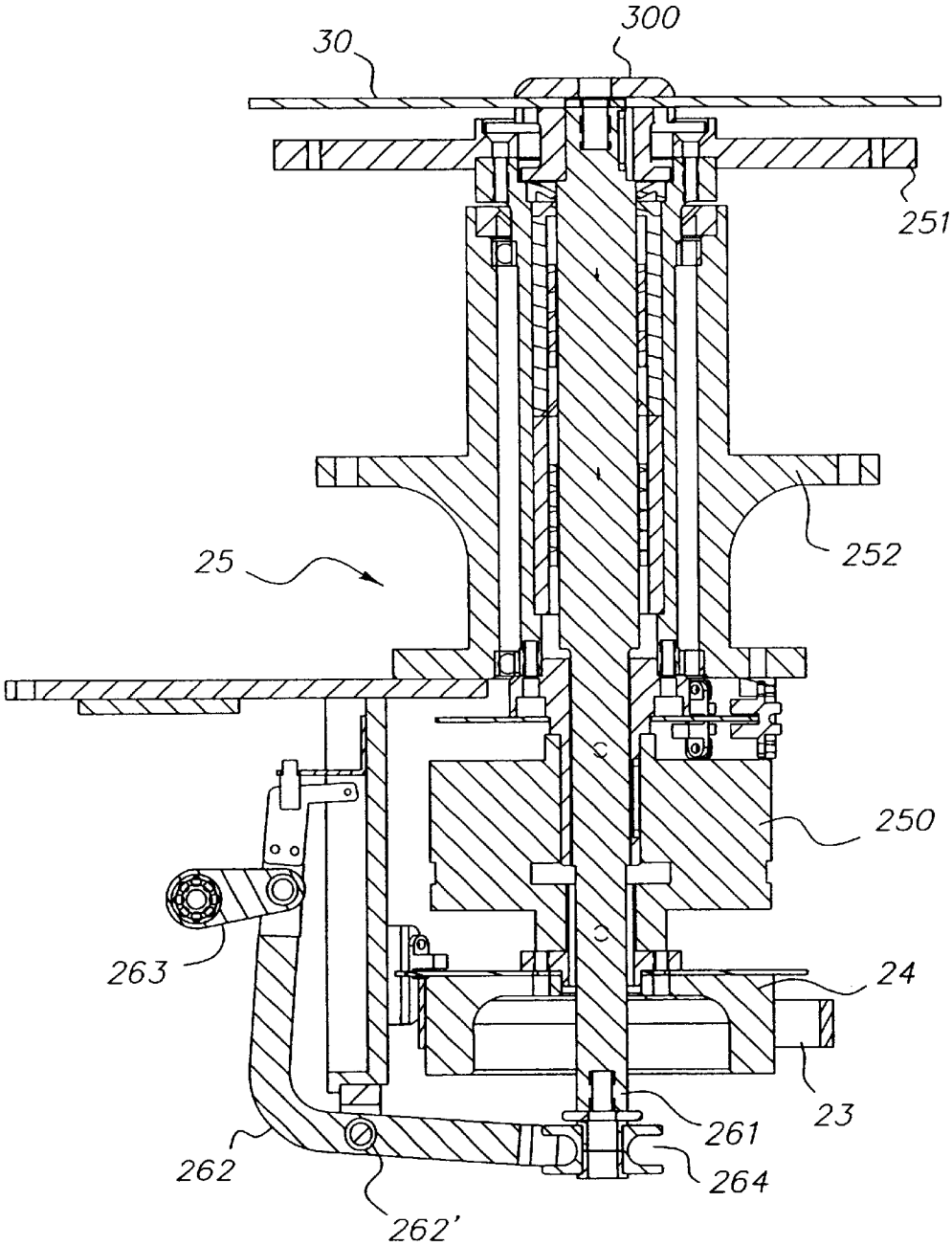
FIG. 9A displays a cross-sectional view of the drum and disk drive mechanism along line A—A in FIG. 8.

Circular processing drum 14 is connected to a drum and disk drive mechanism 25, which selectively rotates disk 30 relative to drum 14 to position and convey the film along and within processing drum 14, and rotates both disk 30 and drum 14 together during a processing and/or cleaning cycle. Circular processing drum 14 rotates about an axis of symmetry. An exemplary drum and disk drive mechanism 25 is shown in FIG. 8. Drum and disk drive mechanism 25 cooperates with a motor 22, a belt 23, and a pulley 24 as shown in FIGS. 8 and 9A. Drum and disk drive mechanism 25 includes a drive shaft 261 which is operationally connected to pulley 24. Also shown in FIGS. 8 and 9A are flanges 251 and 252. Flange 251 is connected to drum 14 while an end cap 300 holds disk 30 for rotation about drive shaft 261 (FIG. 9A). Actuation of motor 22 drives belt 23 which in turn drives pulley 24. This in turn causes a rotation of drive shaft 261 which rotates disk 30. Clutch mechanism 250 enables the engagement and disengagement of flange 251 to provide selective rotation to circular processing drum 14.

Figure 9B:
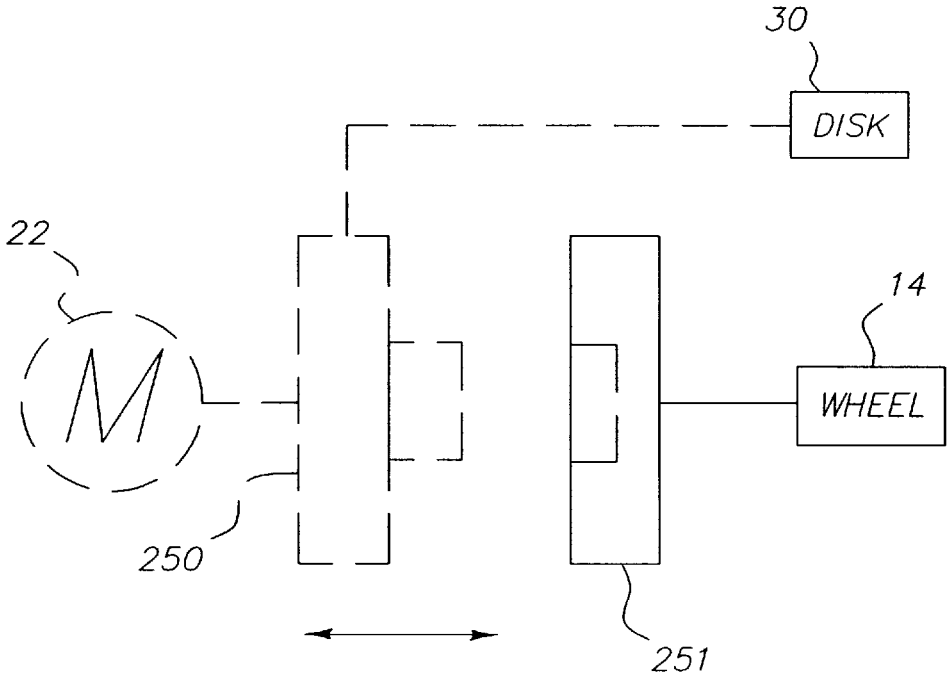
FIG. 9B schematically illustrates a driving and clutching arrangement of the invention.

FIG. 9A displays a cross-sectional view of drum and disk drive mechanism 25 and clutch mechanism 250 along line 9A—9A in FIG. 8. With reference to FIG. 9A and FIG. 9B which is a schematic representation of the driving and clutching feature of the present invention, an operation will now be described. When loading film which will be described with reference to FIGS. 10 and 11, clutch 250 is deactivated as shown in FIG. 9B. In this state, rotation of motor 22 will cause a rotation of drive shaft 261 and accordingly, a rotation of disk 30 relative to drum 14. This is due to the fact that clutch 250 is deactivated and therefore, drum 14 is not rotated. This permits the conveyance of the film by rotation of disk 30 to a desired location within drum 14. After the film reaches the desired location within drum 14, clutch 250 is activated, (for example, clutch 250 is moved to the right in FIG. 9B) by actuating clutch 250 with flange 251 which is attached to drum 14. Therefore, a rotation of motor 22 will cause a rotation of both disk 30 and drum 14. This occurs during the processing stages to process the film in a manner which will be described later, and also during a cleaning stage.

Drive shaft 261 can be moved perpendicularly and through flange 251 and flange 252 to move disk 30 attached thereto. As shown in FIG. 9A, drive shaft 261 is attached to a fitting 264 in a manner which permits drive shaft 261 to rotate relative to fitting 264. Fitting 264 is in turn rotatably attached to a pivotable arm 262 and a movable member 263. Movable member 263 can be operationally connected to a motor for rotation of member 263. This causes arm 262 to pivot about point 262' to move drive shaft 261 to the left or right when viewing FIG. 9A from above the page. Movement of drive shaft 261 as noted above, moves disk 30 in a direction parallel to an axis of disk 30. This facilitates the accommodation of, for example, 35 mm and APS film on disk 30, since the disk 30 can be moved based on the type of film being processed.

Figure 10:
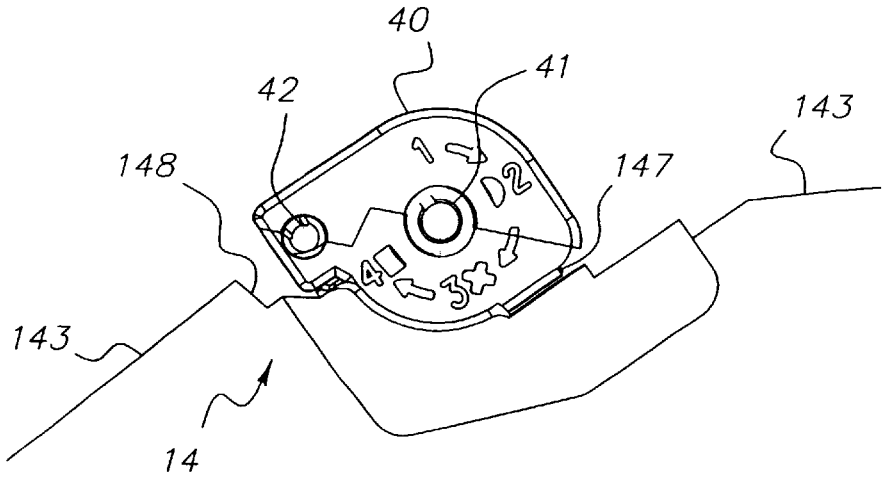
FIG. 10 depicts a film cartridge in a film-loading position using one film-loading method of the present invention.

Within the context of the present invention, a film may be loaded into circular processing drum 14 by a number of methods. One method of loading film, such as APS film, into circular processing drum 14 is shown in FIGS. 10–13. As shown in FIG. 10, film cartridge 40 comprising a film cartridge spool 41 and film cartridge door opening mechanism 52 is positioned in a film cartridge loading area 147 located on side wall 143 of circular processing drum 14. Film (not shown) exiting film cartridge 40 enters circular processing drum 14 at light tight film input slot 148 (FIG. 3) in side wall 143 of circular processing drum 14.

Figure 11:
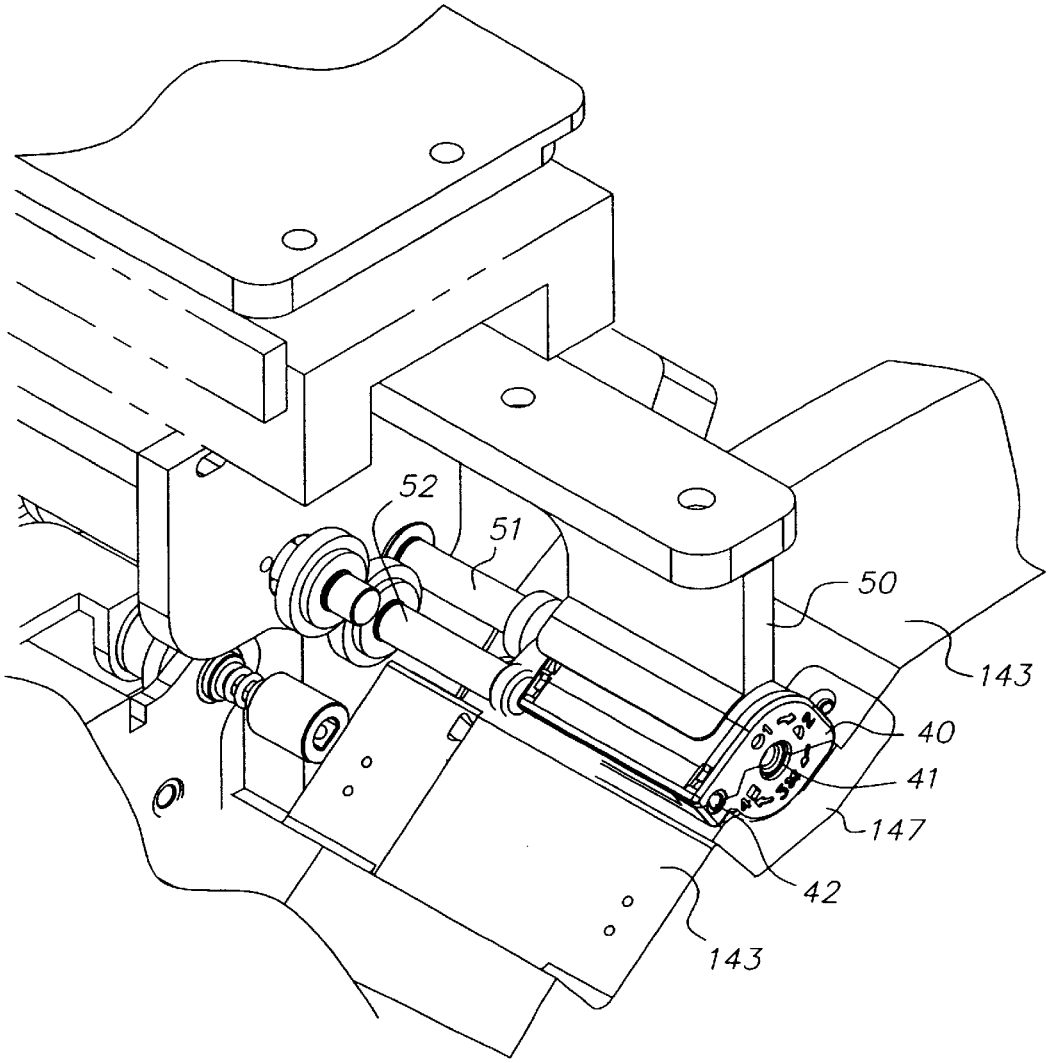
FIG. 11 depicts a film cartridge stabilizing step in one film-loading method of the present invention.

Once film cartridge 40 is positioned in film cartridge loading area 147, photographic processor 10 can initiate a number of film-loading and conveying steps, the results of which are shown in FIG. 11. It is noted that the film loading and conveying steps as well as other processing steps can be controlled by a computer or central processing unit (CPU) 2000 (FIG. 1) operationally associated with processor 10. In a first step, a film cartridge stabilizing member 50 applies an amount of pressure onto an upper surface of film cartridge 40 to prevent film cartridge 40 from moving while positioned in film cartridge loading area 147. Spool engaging member 51 and cartridge door opening mechanism engaging member 52 move toward film cartridge 40 and engage with film cartridge spool 41 and film cartridge door 42, respectively. Door opening mechanism engaging member 52 opens film cartridge mechanism 42 and spool engaging member 51 begins to rotate film cartridge spool 41, forcing film (not shown) out of film cartridge 40.

Figure 12:
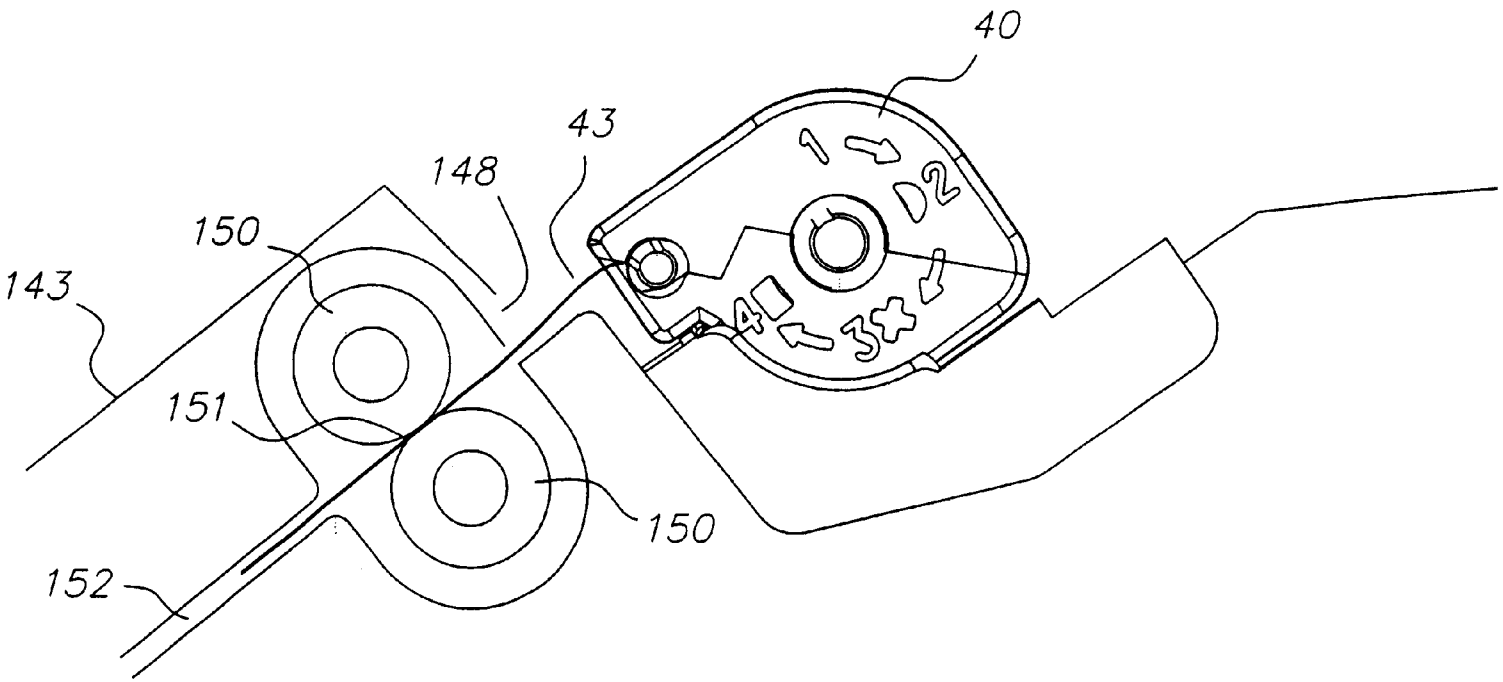
FIG. 12 depicts a film nipping step during a film-loading method of the present invention.
Figure 13:
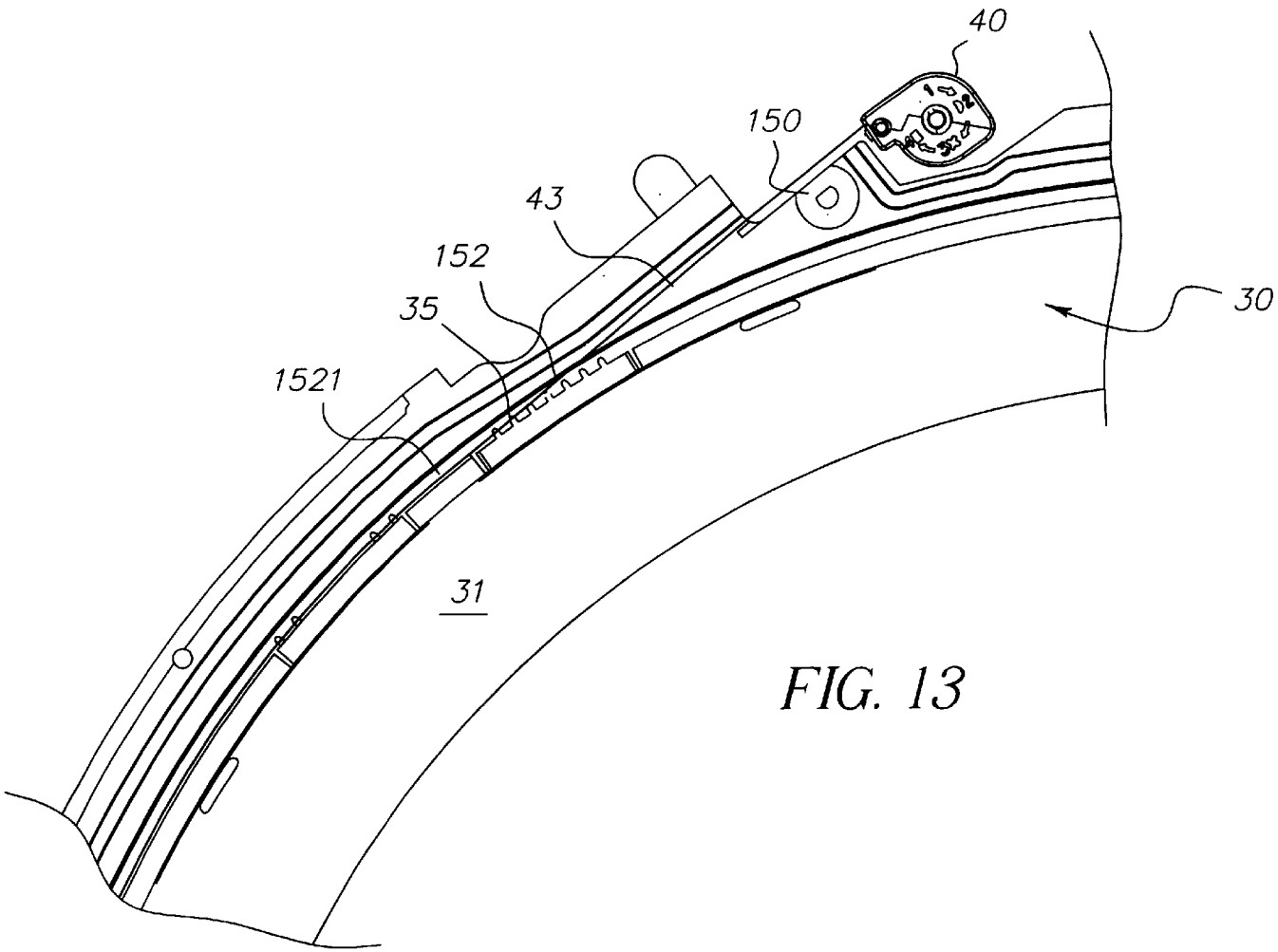
FIG. 13 depicts a cross-sectional view of film entering into a circular processing drum in one film-loading method of the present invention.

FIG. 12 shows a strip of film 43 exiting film cartridge 40 and entering film input slot 148 of circular processing drum 14. Driven nip rollers 150 grasp a leading edge of the strip of film 43 at drum roller nip point 151 and advance film 43 further into circular processing drum 14. As shown in FIG. 13, the strip of film 43 exits drum cavity slot 152 and enters into the drum processing cavity 1521 of circular processing drum 14, wherein one or more sets of disk teeth 35 on disk 30 interengage with holes or perforations along an edge of the strip of film 43. As previously described, disk teeth 35 could be spring loaded so as to spring up at the appropriate time and interengage with the holes or perforations along film 43. With clutch 250 disengaged, disk 30 and rollers 150 are rotated while circular processing drum 14 remains stationary. This causes film 43 to advance into the processing cavity 1521 of circular processing drum 14 a desired distance equal to the length of the strip or roll of film 43. As shown in FIGS. 10–13, in this film-loading method the film 43 remains intact with film cartridge 40.

A number of commercially available films may be loaded according to the film-loading method described above, namely, wherein the film remains intact with its corresponding film cartridge during processing. A suitable film, which may be used in this particular film-loading method, includes, but is not limited to, APS film. Desirably, APS film is loaded into the photographic processor of the present invention according to this method.

Figure 14:
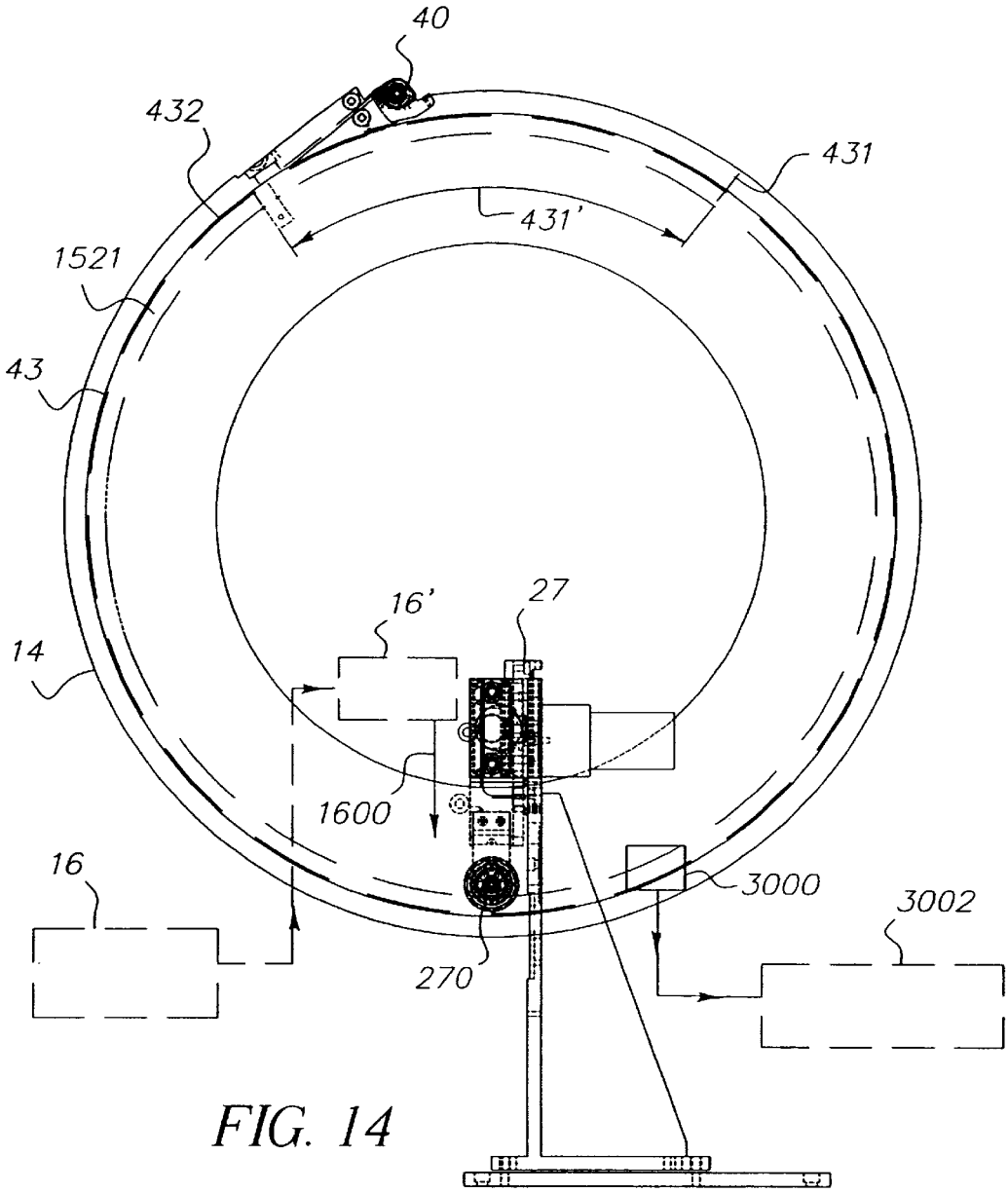
FIG. 14 depicts a sheet of film having a lead end and a tail end within the drum processing cavity of a circular processing drum.

FIG. 14 depicts circular processing drum 14 fully loaded with film 43 having a forward end 431 and a rearward end 432 within the drum processing cavity 1521 of circular processing drum 14. The back end of film 43 is maintained in cartridge 40. Film 43 is now positioned within circular processing drum 14 for chemical processing, wherein one or more processing fluids are deposited into circular processing drum 14 and placed in contact with film 43 for a desired period of time.

It is noted that the circumference of the drum will be longer than the length of the film to be processed. Therefore, when the film is loaded in drum 14, a section of drum 14 will not have film therein. This is referred to as a film-free zone 431' (FIG. 14). Prior to delivering chemistry by way of chemical supply 16 and a chemical delivery mechanism 16' (FIG. 14), clutch 250 is activated or engaged and drum 14 is controllably rotated with disk 30 so that film-free zone 431' is at a lower end or below chemical delivery mechanism 16'. Chemical delivery mechanism 16' is preferably of the type which drops or delivers chemistry into drum 14 in the direction of arrow 1600 (FIG. 14). The movement of film-free zone to an area below chemical delivery mechanism 16' prior to the delivery of chemicals prevents the chemicals from being dropped directly on the film which could cause uneven processing. Thereafter, processing occurs by continuously rotating the drum 14 and disk 30. Further, as shown in FIG. 14, in the lower portion of drum 14, film 43 passes between wheel 270 and an inner surface of drum 14. Rotation of drum 14 and disk 30 relative to wheel 270 helps to agitate the processing fluid in the vicinity of wheel 270 to promote processing. Drum 14 can be selectively rotated in a continuous or intermittent manner. Following the chemical processing steps, the film 43 is removed from circular processing drum 14 and exposed to a drying operation. One method of removing film 43 from circular processing drum 14 is shown in FIGS. 15A and 15B.

Figure 15A:
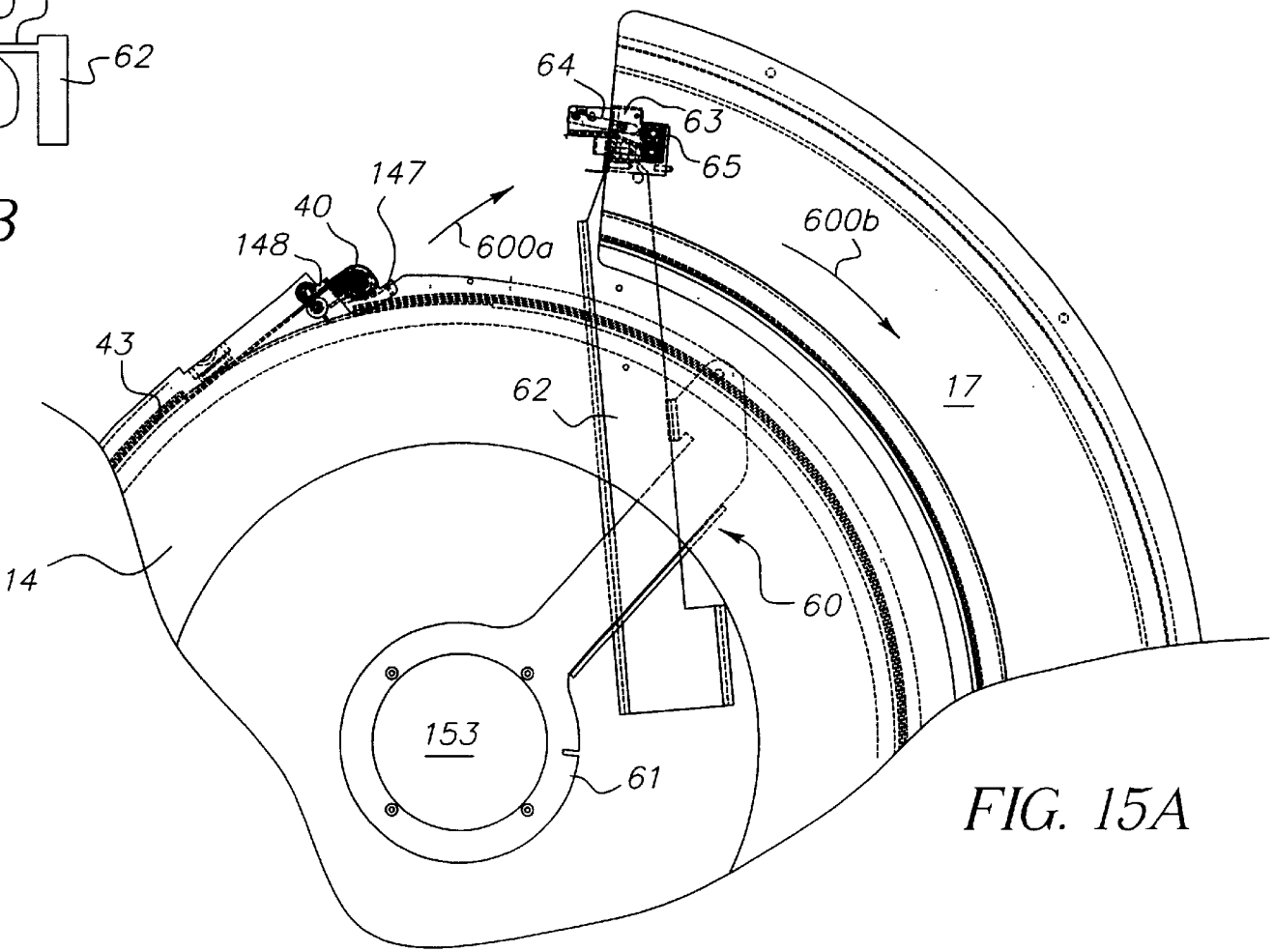
FIGS. 15A and 15B depicts an exemplary film transfer arm, which transfers film from a circular processing drum to a dryer.
Figure 15B:
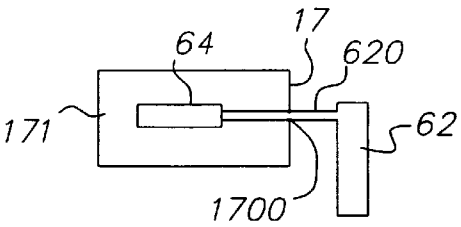

As shown in FIG. 15A, film transfer arm assembly 60 is positioned to move or pivot between circular processing drum 14 and dryer 17. Film transfer arm assembly 60 includes a lower arm member 61, which is rotatable around an axis of symmetry 153 of circular processing drum 14. Film transfer arm assembly 60 also includes an upper arm member 62, which is pivotally attached to lower arm member 61. At upper arm member end 63, film transfer arm assembly 60 includes a film cartridge gripper 64 and film strip gripper rolls 65. As shown in FIG. 15B, which is a front view of the entrance of dryer 17, a side wall of dryer 17 includes a slot 1700 with a rubber seal that extends along the length of the dryer. Upper arm member 62 includes a shaft 620 which extends from upper arm member 62, through slot 1700 and is connected to gripper 64. This permits transfer arm assembly 60 to pull gripper 64 and thus the film to be dried though the dryer.

In embodiments wherein the film 43 remains intact with film cartridge 40 (as described above), film cartridge gripper 64 of film transfer arm assembly 60 engages with film cartridge 40, pulls film cartridge 40 from loading area 147 and the strip of film 43 from circular processing drum 14 in direction 600*a*, and proceeds through dryer 17 in direction 600*b*. Therefore, cartridge 40 with processed film 43 attached and trailing therefrom is conveyed through dryer 17 to dry film 43 by, for example, the blowing of air into dryer 17. In other embodiments where the film 43 is detached from film cartridge 40 (described below), film sheet gripper rolls 65 grip an edge of film 43 as film 43 exits film input slot 148 of circular processing drum 14. Film sheet gripper rolls 65 of film transfer arm assembly 60 pull film 43 from circular processing drum 14 and proceeds through dryer 17. Once dried, film 43 is re-wound back into its cartridge 40 prior to proceeding to scanner 18'.

Figure 16:
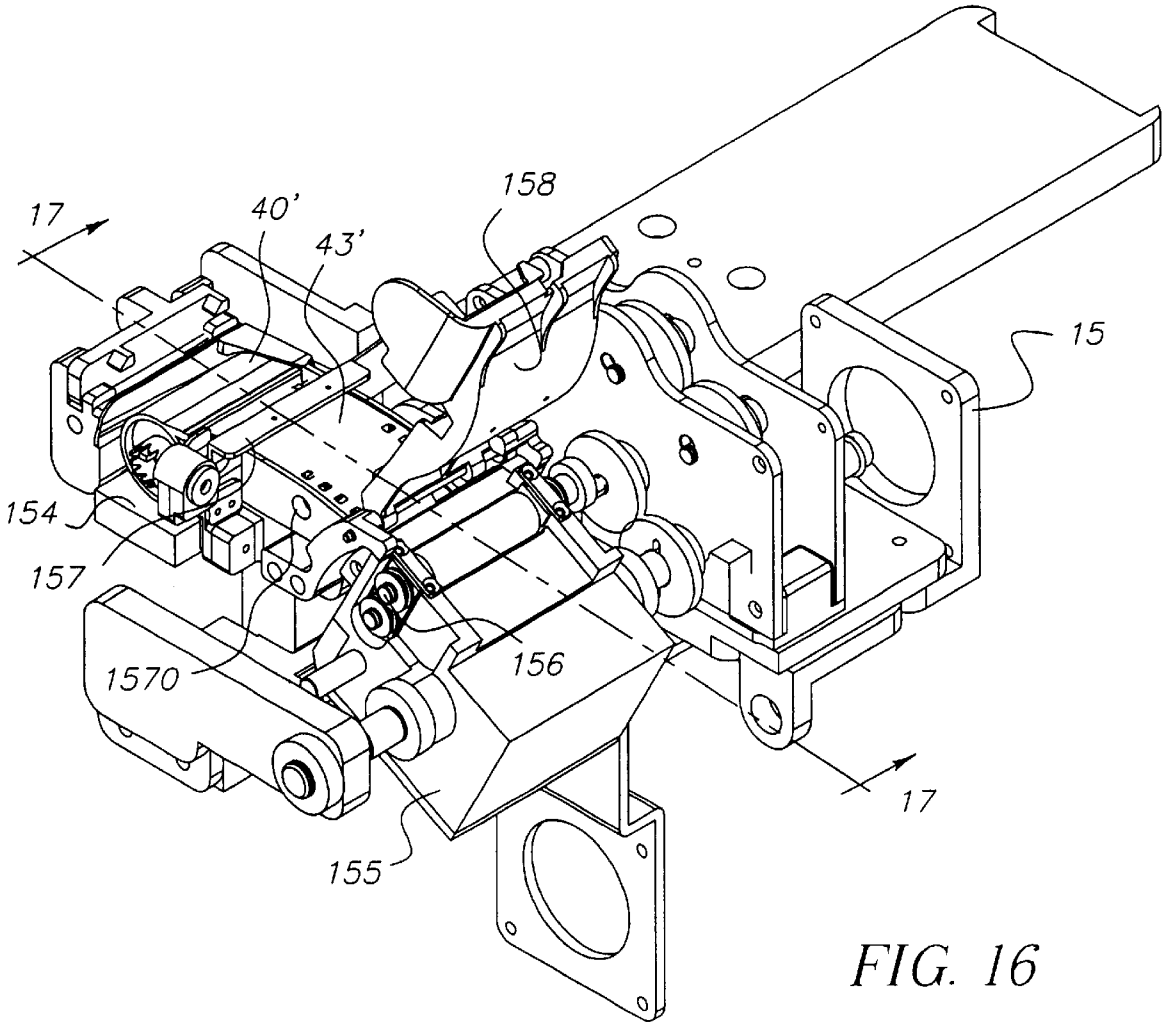
FIG. 16 depicts an exemplary film loading/unloading device used in a film-loading method of the present invention wherein film is separated from its corresponding film cartridge.

In a further film-loading method, the film is separated from its film cartridge prior to processing within circular processing drum 14 (for example, 35 mm film). In this method, a film loading/unloading device, such as exemplary film loading/unloading device 15 as shown in FIG. 16, may be used. Film loading/unloading device 15 includes a film cartridge loading area 154, which can be enclosed by closing a door 158. In film loading area 154, an operator extracts the tongue of film 43' from cartridge 40' and engages the perforations on film 43' with sprockets on a driven roller 1570. Thereafter door 158 is closed and film 43' proceeds into festoon box 155 through festoon box nip rollers 156. Once a desired length of film is removed from film cartridge 40', a cutter 157 slices film 43' to separate film 43' from film cartridge 40'. Any counter device (not shown) may be used to measure the length of the strip of film 43' passing through festoon box nip rollers 156. The length measurement is used in further processing steps as described below.

Figure 17:
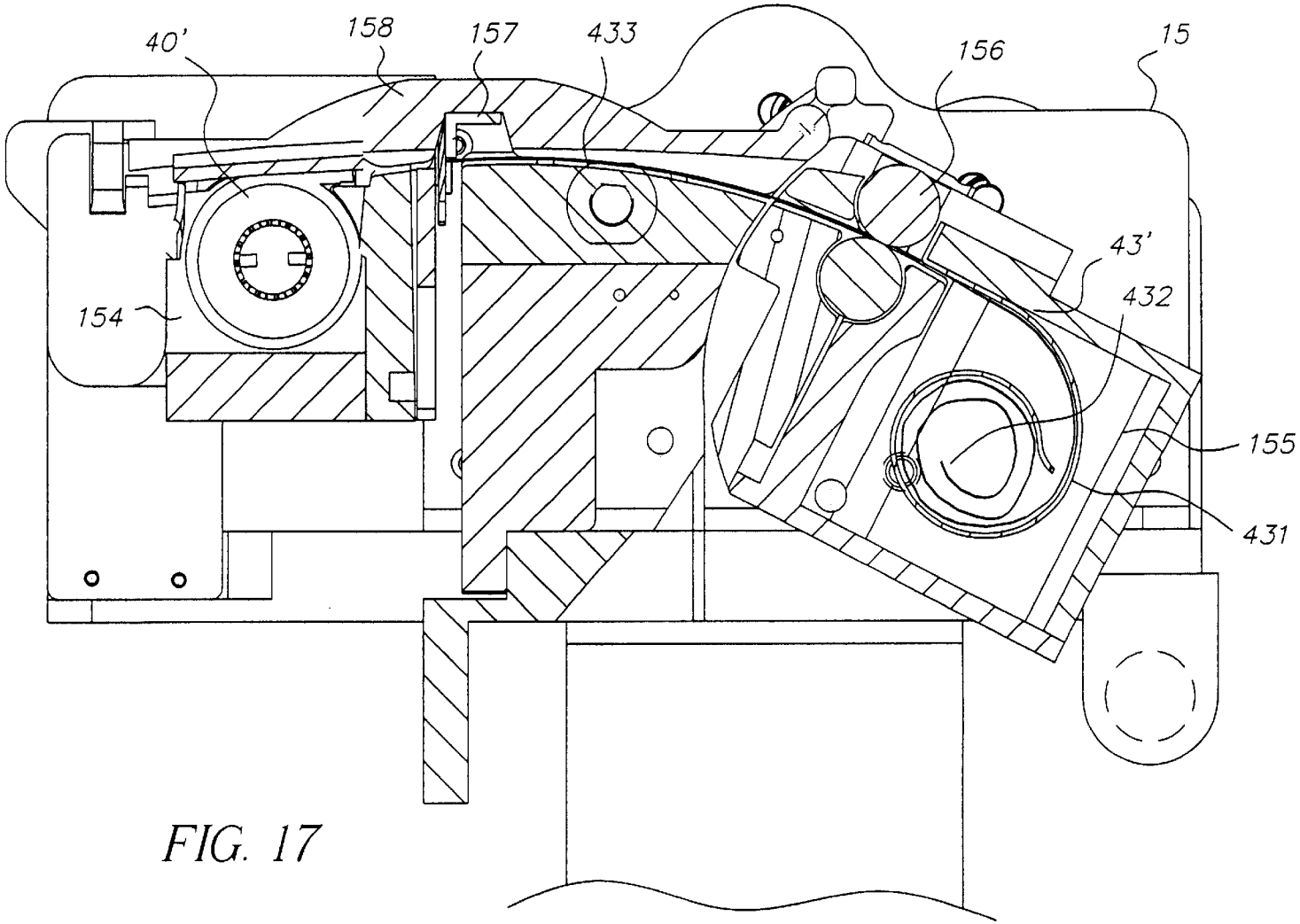
FIG. 17 depicts a cross-sectional view of the exemplary film loading/unloading device as seen along line B—B in FIG. 16.

FIG. 17 depicts a cross-sectional view of film loading/unloading device 15 as seen along line 17—17 in FIG. 16. As shown in FIG. 17, film cartridge 40' is positioned in film cartridge loading area 154 while a strip of film 43' is removed from film cartridge 40' and transported to festoon box 155 where it is turned. In this film-loading operation, a reverse roll of film 431 is formed from the film 43' in festoon box 155. A lead end of film 432 becomes the innermost portion of the reverse roll 431 while a tail end of film 433 becomes the outermost portion of reversed roll 431. When the film 43' is subsequently fed into circular processing drum 14 (as previously described), tail end 433, which contains the last exposures on the strip of film 43',is fed into circular processing drum 14 first.

Figure 18:
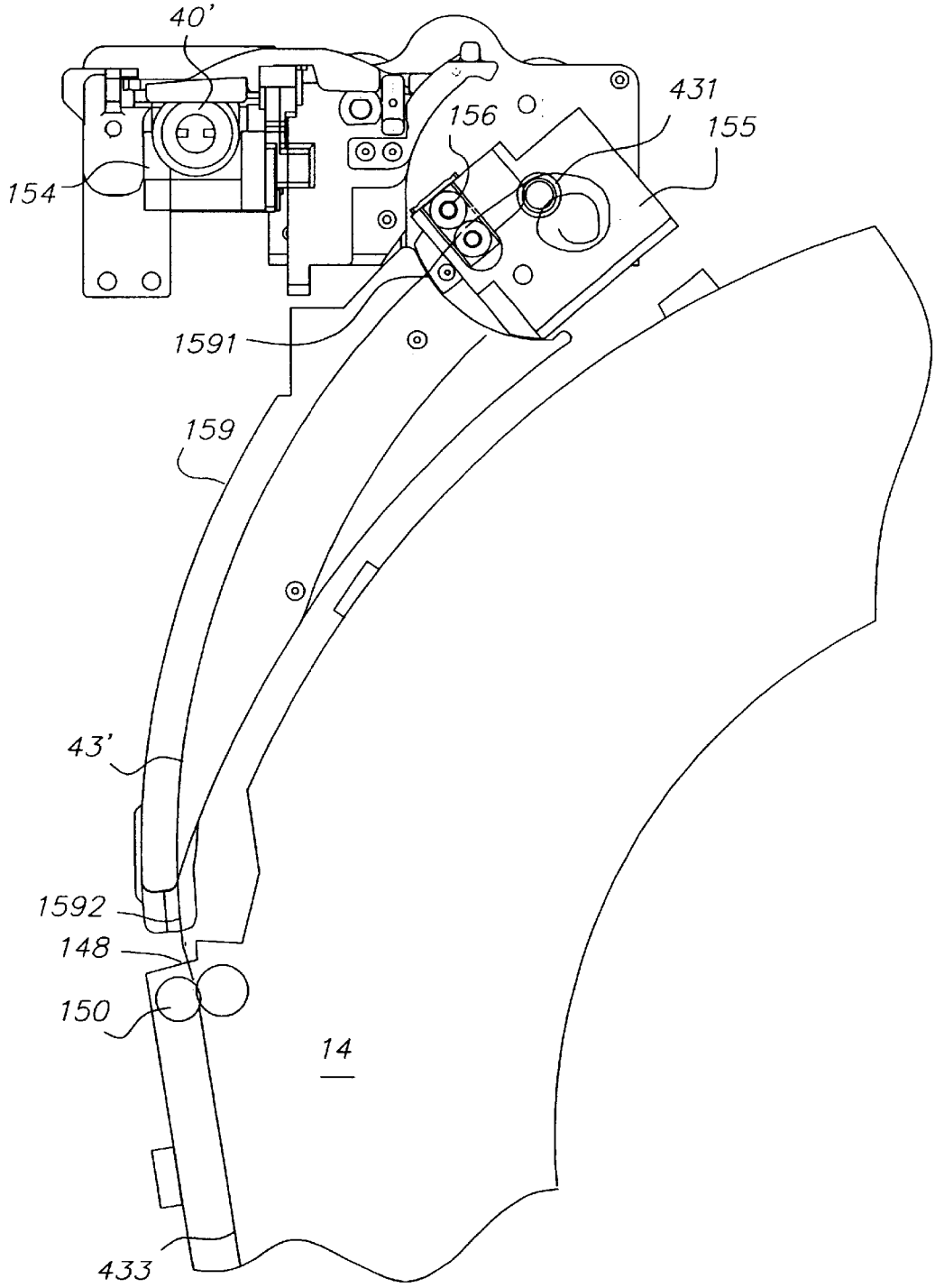
FIG. 18 depicts an exemplary film-loading guide used to load a film roll into a circular processing drum.

A film-loading guide 159 is used to load reverse roll 431 into circular processing drum 14 as shown in FIG. 18. Festoon box 155 rotates from an initial position (as shown in FIGS. 16 and 17) to a film-loading position as shown in FIG. 18. Festoon box nip rollers 156 turn to advance tail end 433 of reverse roll 431 into film-loading guide 159 at guide entrance slot 1591. The film 43' exits the film-loading guide 159 at guide exit slot 1592 positioned adjacent to film input slot 148 of circular processing drum 14. Once the tail end 433 of the strip of film 43' enters into circular processing drum 14, driven nip rollers 150 grab the film 43' and advance the film 43' into circular processing drum 14 as described above. It should be noted that in this film-loading method, nip rollers 150 are programmed to advance the film 43' into circular processing drum 14 a specific length, which corresponds to the length of film inputted into festoon box 155 and measured via festoon box nip rollers 156 as described above. In other words, nip rollers 150 advance the strip of film 43' into circular processing drum 14 so that lead end 432 of film 43' remains nipped between nip rollers 150 during chemical processing (i.e., lead end 432 of the strip of film 43' does not enter into drum processing cavity 1521). This permits all of the exposed areas of the film 43' to be in the processing area in the drum.

Figure 19:
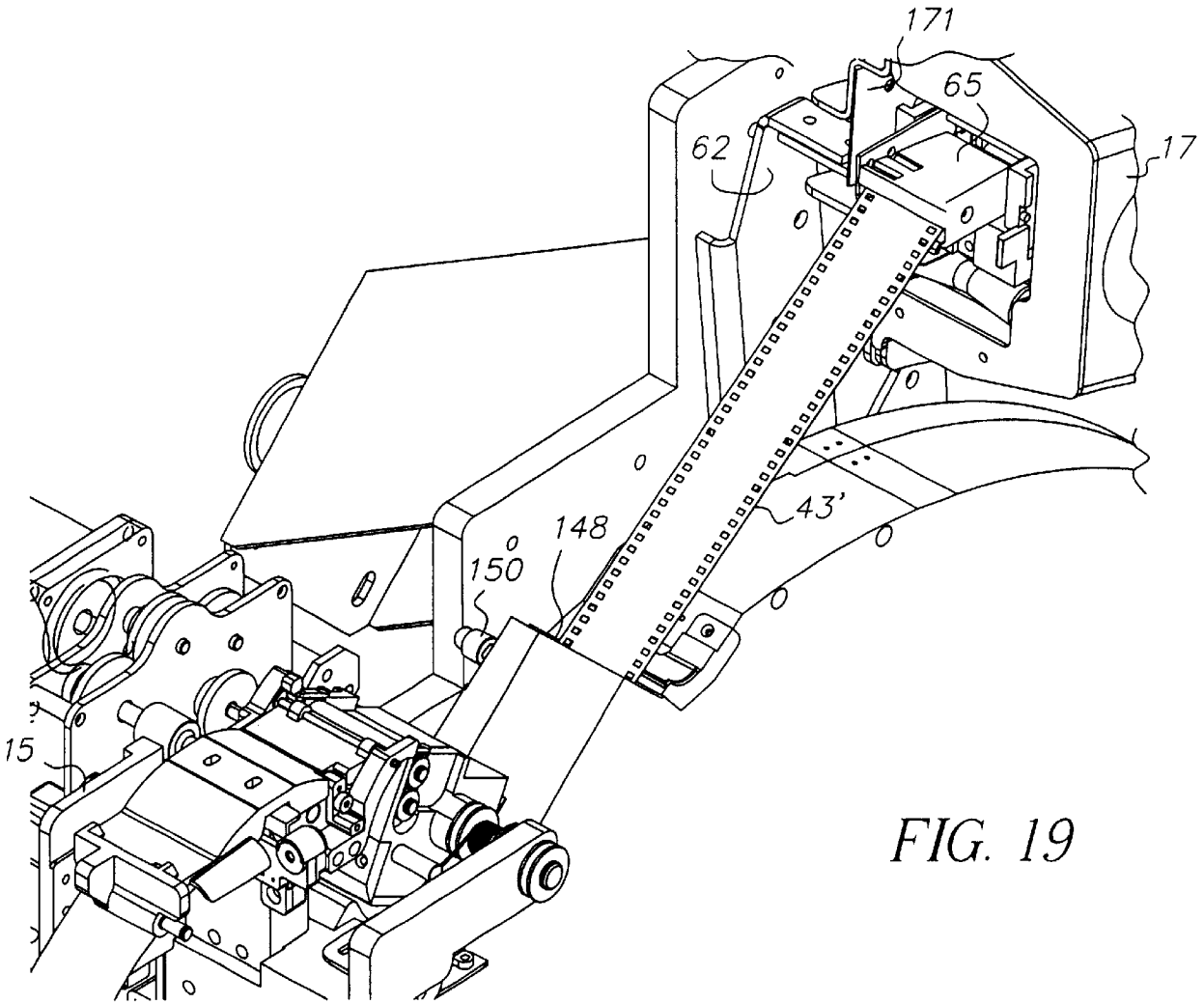
FIG. 19 depicts a film transfer step, wherein a strip of film is transferred from a circular processing drum to a dryer by film sheet gripper rolls attached to a film transfer arm.
Figure 20:
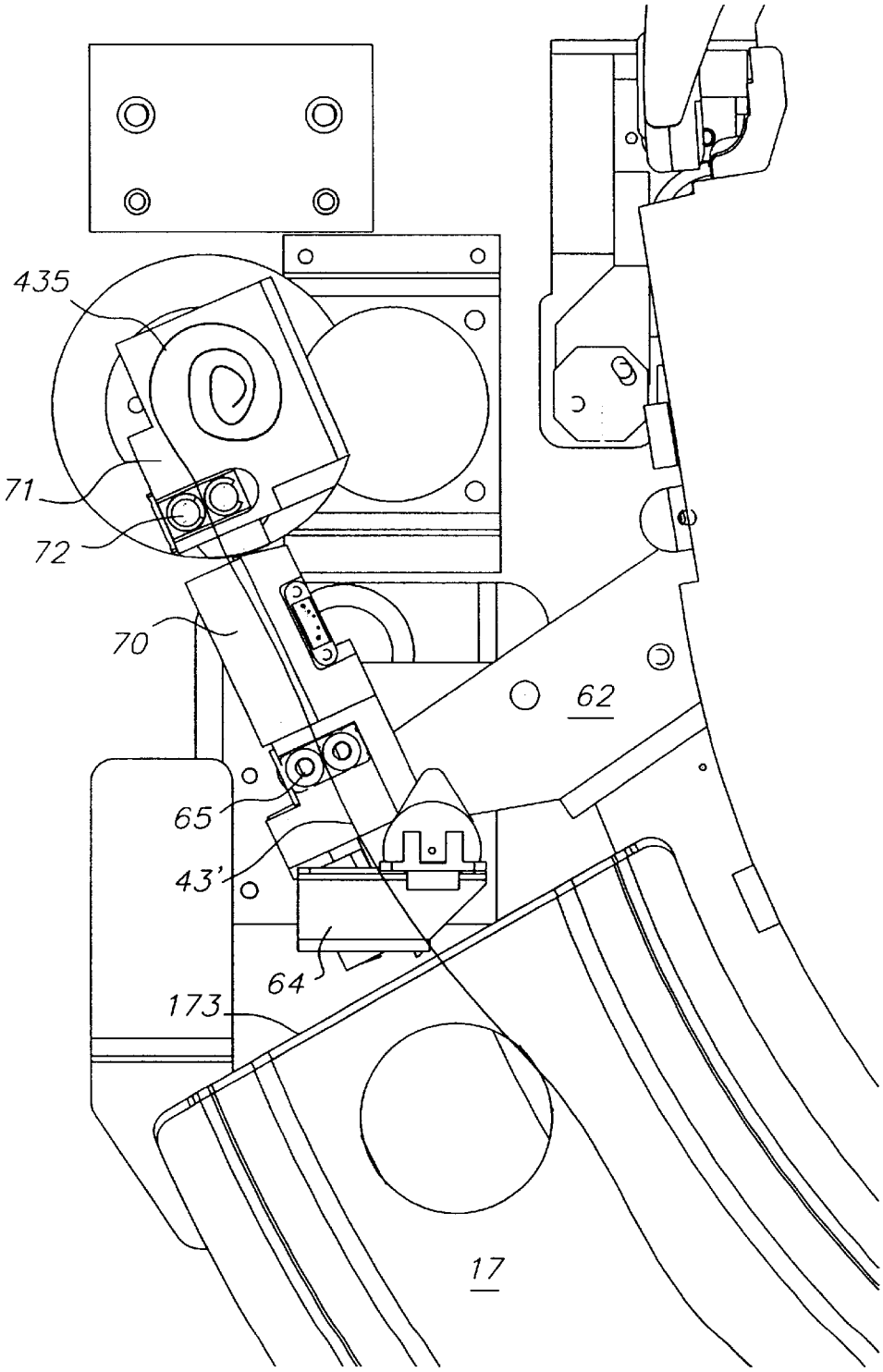
FIG. 20 depicts a film processing step, wherein a strip of film exits a dryer into a scanner festoon box.

Following the chemical processing steps, film 43' is transferred to dryer 17 by film transfer arm assembly 60 as described above. As shown in FIG. 19, the strip of film 43' is pulled from circular processing drum 14 through film input slot 148 by film sheet gripper rolls 65 attached to upper transfer arm member 62. Nip rollers 150 provide a first end (corresponding to lead end 432) to film sheet gripper rolls 65. In FIG. 19, film sheet gripper rolls 65 are shown positioned at dryer entrance 171. From this position, film sheet gripper rolls 65 proceed through dryer 17 pulling the film 43' through dryer 17. As shown in FIG. 20, upper film transfer arm member 62 exits dryer 17 at dryer exit 173 and comes into contact with a conduit 70. Film sheet gripper rolls 65 turn to advance the film 43' through conduit 70 and into scanner festoon box 71. Scanner festoon box nip rollers 72 grasp a leading edge of film 43' and force film 43' into scanner festoon box 71 forming scanner film roll 435. Scanner festoon box nip rollers 72 advance film 43' into scanner festoon box 71 a specific distance equal to the predetermined length of film 43' so that the tail end of film 43' remains nipped between scanner festoon box nip rollers 72 to go to the scanner.

Figure 21:
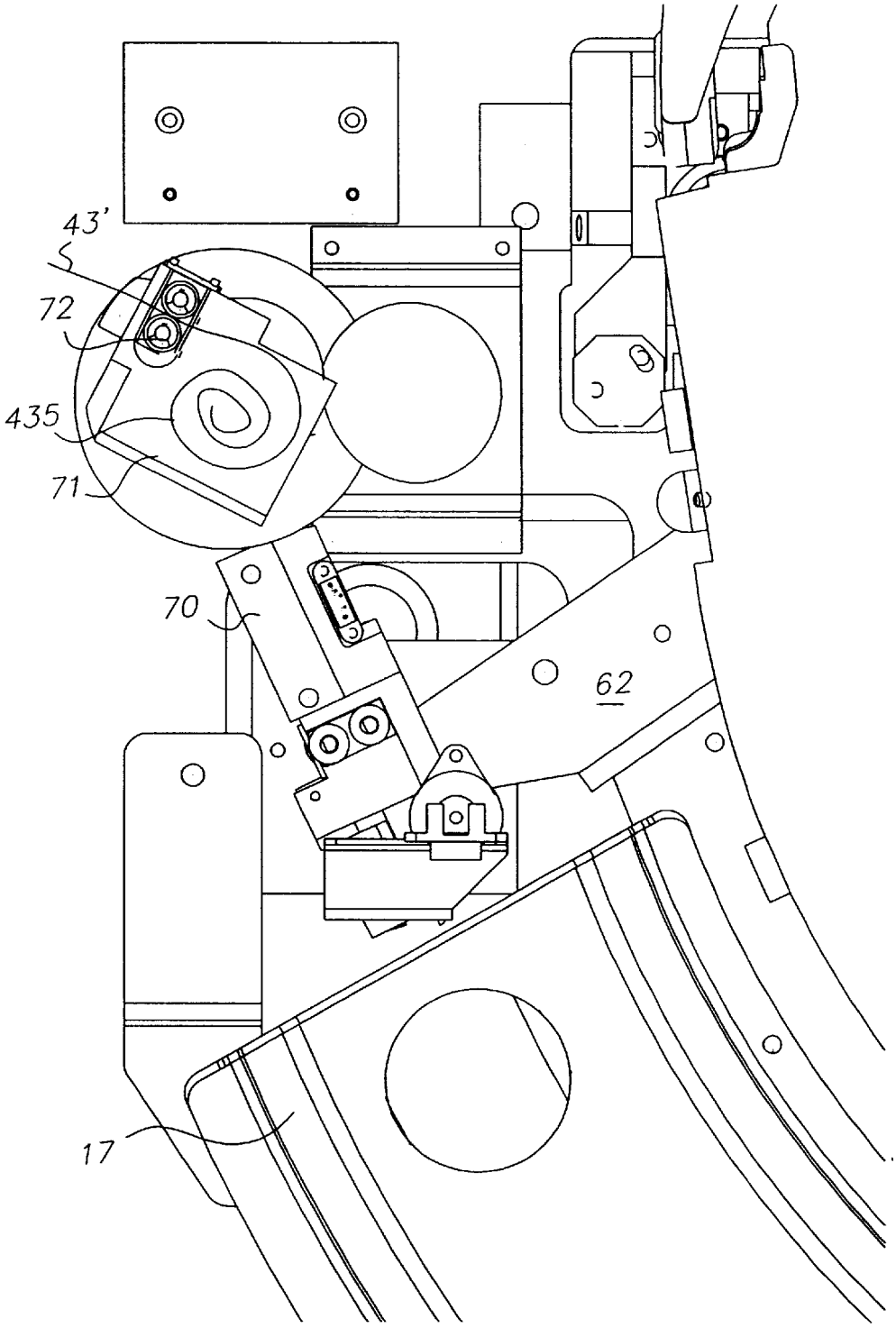
FIG. 21 depicts a film processing step, wherein a strip of film exits a festoon box and proceeds to a scanner.

In one embodiment, film 43' may be further processed by transporting the film 43' to scanner 18'. As shown in FIG. 21, scanner festoon box 71 rotates from an initial position (as shown in FIG. 20) to a secondary position so that the film 43' may be fed to scanner 18'. Scanner 18' may supply image data to computer 2000 or a remote computer (not shown) for further image processing. Following scanning, the film 43' may be packaged as a film roll or as strips of film and returned to the customer along with scanned photographs in electronic format on an electronic disc if desired.

A number of commercially available films may be loaded according to the film-loading method described above, namely, wherein the film is separated from its corresponding film cartridge during processing. Suitable films, which may be used in this particular film-loading method, include, but are not limited to, 135 mm film. Desirably, 135 mm film is loaded into the photographic processor of the present invention according to this method.

The photographic processor as described may be used to process one or more types of film. Suitable films include, but are not limited to, APS film, 135 mm film, etc. Desirably, the photographic processor is designed to process APS film, 135 mm film, or both APS and 135 mm film. However, the invention is not limited to APS and 135 mm film and it is recognized that other types of film such as 120 format and 110 format can also be processed in the processor of the present invention. The photographic processor may be categorized as a "single-roll", "single use" or "batch" processor given that the circular processing drum only chemically processes one roll of film at a time.

The photographic processor as described may include other components other than those described in FIGS. 1–21. For example, the photographic processor may include an operator interface control panel operationally associated with computer 2000(FIG. 1); a display screen; a control unit, wherein the control unit accepts input from a processor user, provides machine settings to one or more components of the processor based on the input of the user, and controls and executes a processing operation of the processor; and multiple film loading doors on an outer surface of the photographic processor housing. In one desired embodiment, the photographic processor is used to process APS film and 135 mm film. In this embodiment, the photographic processor has two separate film loading doors on an outer surface of the photographic processor housing, one for an APS film cartridge and the other for a 135 mm film cartridge.

The photographic processor as described may use any conventional chemical delivery system known in the art as long as the chemical delivery system is capable of inputting one or more processing fluids into the circular processing drum. Suitable chemical delivery systems deliver one or more processing fluids including, but not limited to, a developing solution, a bleach solution, a fix solution, a wash solution, a combination or a concentrate thereof. Desirably, the chemical delivery system comprises one or more separate containers for each of the processing fluids. For example, the chemical delivery system may comprise one or more separate containers containing a developing solution, one or more separate containers containing a bleach solution, one or more separate containers containing a fix solution, and one or more separate containers containing a wash solution. In one embodiment of the present invention, the chemical delivery system used in the photographic processor comprises one container of developing solution, one container of bleach solution, one container of fix solution, and at least one container of wash solution.

Desirably, the photographic processor of the present invention utilizes a chemical delivery system comprising "working strength" chemical solutions. As used herein, the term "working strength" is used to describe chemical solutions, which are prepackaged in separate containers at concentrations that do not require dilution with other solutions (i.e., a source of water), and can be used as is. The system can very easily work with concentrates that are measured, diluted and heated on board. They can be diluted with water (if a supply is available) or with a simple rinsing solution that contains water and a surfactant.

Further, the photographic processor as described may use any conventional chemical removal system to remove or discard one or more processing fluids from the circular processing drum. Suitable chemical removal systems include, but are not limited to, a suction device or a drain 3000 (FIG. 14) in the side wall of the circular processing drum. Typically, the chemical removal system further comprises a chemical waste reservoir 3002 (FIG. 14) for storing one or more processing fluids removed from the drum. Desirably, the chemical waste reservoir is designed to contain all of the waste resulting from the use of all of the processing fluids contained in the chemical delivery system.

Figure 22:
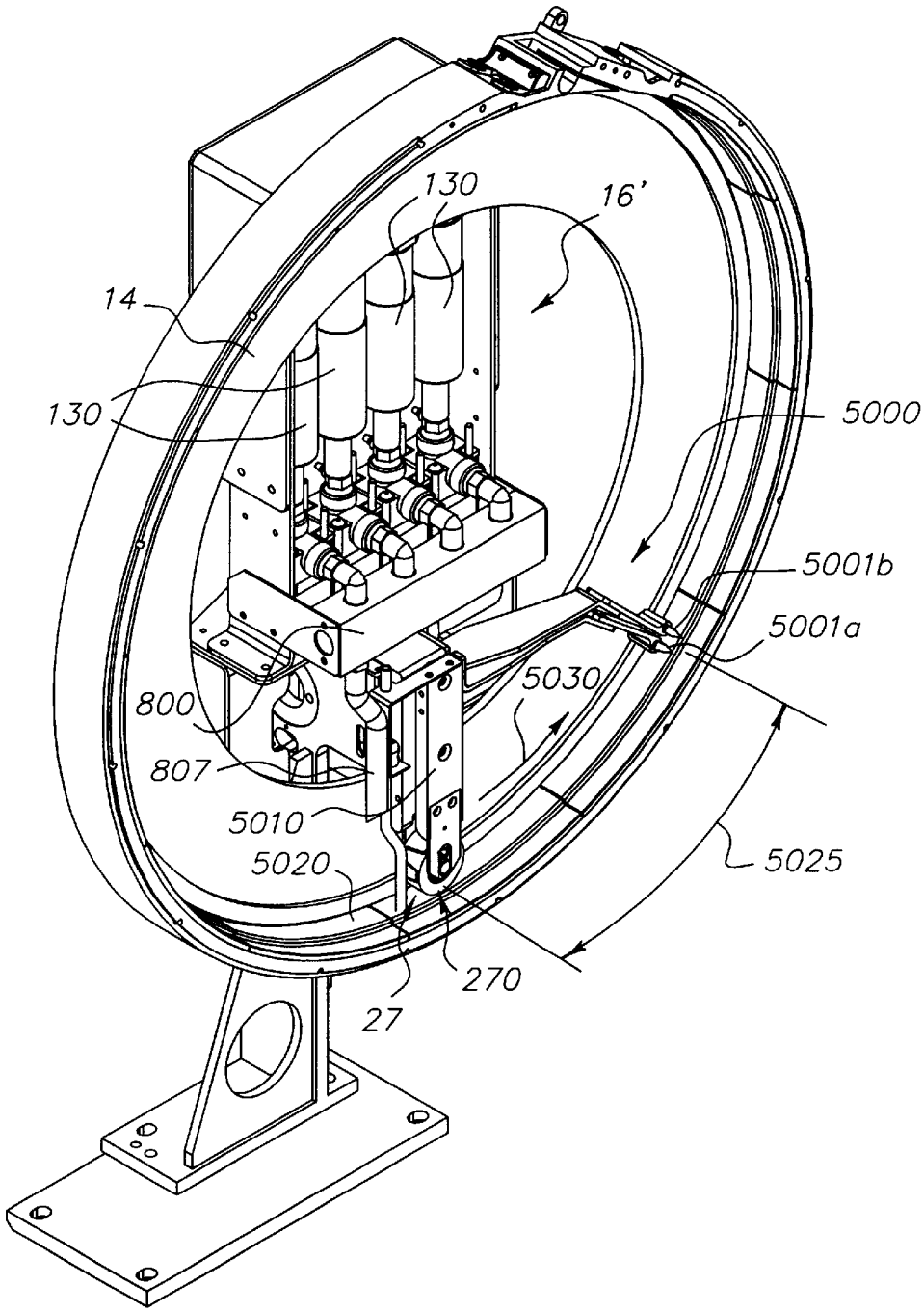
FIG. 22 is a perspective view of a further embodiment of a photographic processor in accordance with the present invention, wherein the processor includes an adjustable metering blade.
Figure 23:
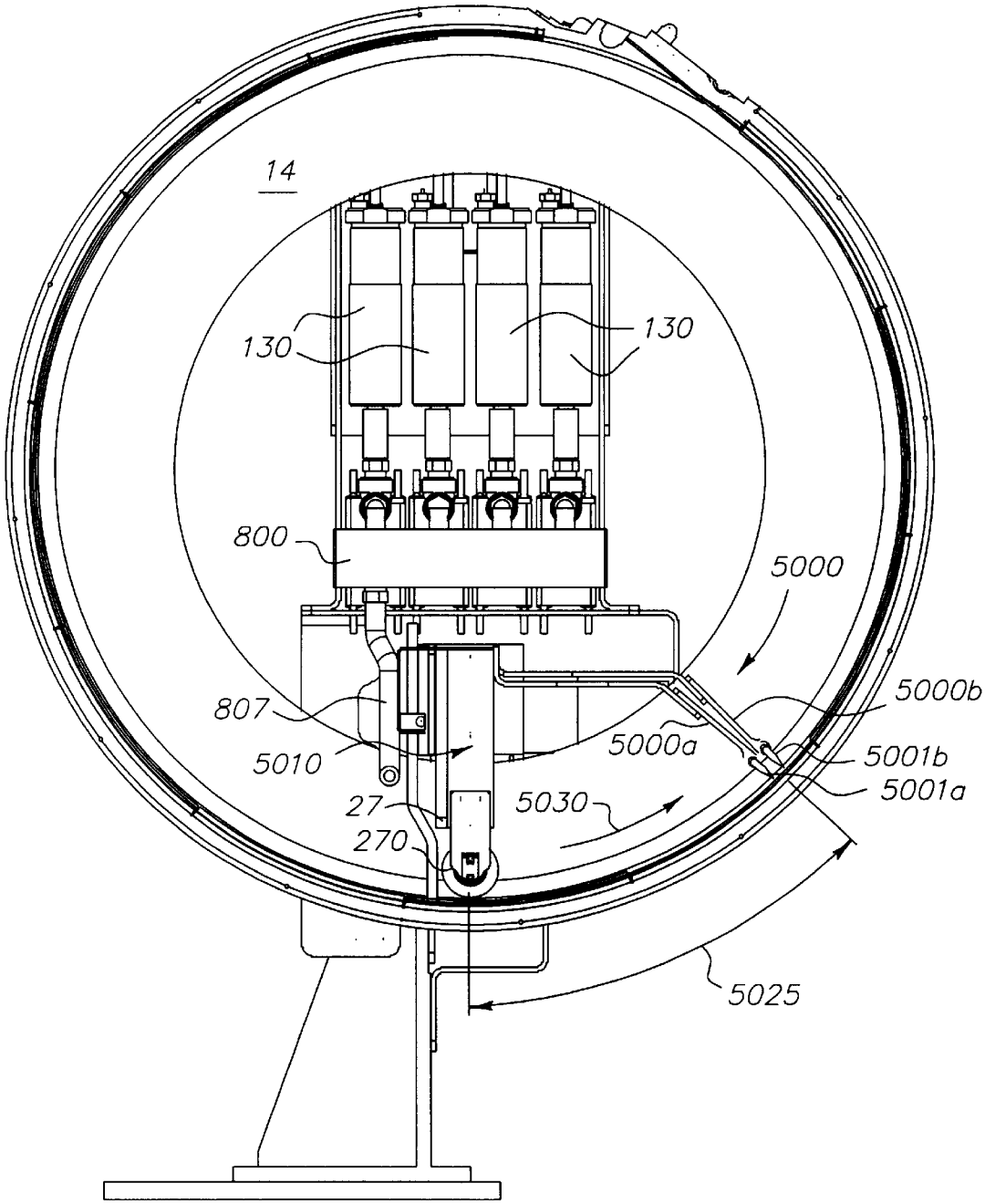
FIG. 23 is a side view of the processor of FIG. 22.

As described with reference to FIG. 14, in a feature of the present invention, a chemical supply 16 and a chemical delivery mechanism 16' are utilized to deliver chemistry, i.e. processing solution to the processing drum. Chemical delivery mechanism 16' is preferably of the type which drops or delivers chemistry into drum 14 in the direction of arrow 1600 as shown in FIG. 14. One type of chemical delivery mechanism 16' is shown in FIGS. 22 and 23 and described in co-pending application U.S. application Ser. No. 10/164,067. As an example, chemical delivery mechanism 16' can include a plurality of chambers 130 which deliver chemical or processing solution via a piping system to a manifold 800. Manifold 800 can include an outlet in the form of a tube 807 which supplies processing solution to the lower part of processing drum 14 so as to process photographic film in a film path 1520 which is defined along an inner perimeter of drum 14.

Figure 24A:
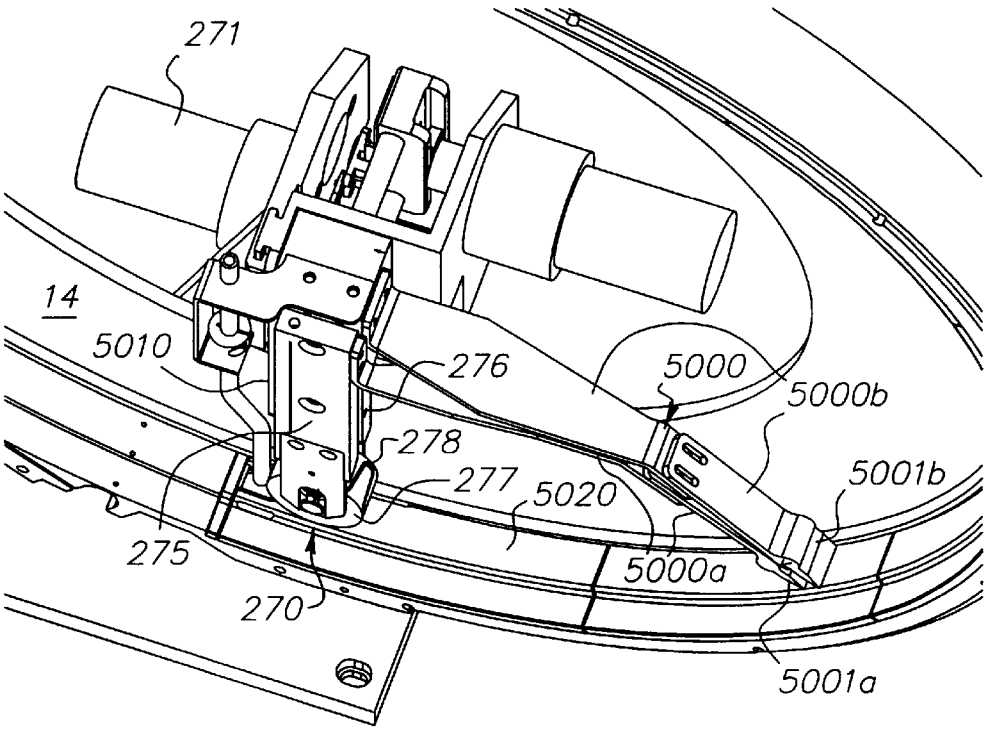
FIG. 24A is a view of the metering blade of FIG. 22, wherein the metering blade is adjusted for APS film.

As described with reference to FIG. 7, the photographic processor of the present invention includes a roller arrangement or assembly 27 (also referred to herein as an agitating roller assembly 27). As shown in FIG. 24A, agitating roller assembly 27 includes a roller 270 which comprises an interengaging member 277 and an interengaging member 278 (also referred to herein as a first roller member 277 and a second roller member 278). As shown in FIG. 23, a support assembly 5010 is used to support roller 270.

As further described with reference to FIG. 7, during use, film passes between roller members 277, 278 and an interior surface of drum 14 (along film path 1520). Roller members 277, 278 are freely rotatable and maintain the film flat along the lower portion of drum 14. Roller members 277, 278 further provide an agitating feature within processing drum 14 during processing by rotating within the processing solution as the film passes along film path 1520. As also described with reference to FIG. 7, the width of roller 270 is adjustable to accommodate shorter width film and larger width of film, and can further be vertically adjustable to accommodate for film curl as the film passes between roller 270 and the interior surface of drum 14. As a still further option, roller 270 can be spring loaded so as to accommodate any variation in the interior surface of drum 14.

During the processing of photographic film within drum 14, it is beneficial to control the amount of solution on the film and prevent unwanted circulation of solution to other parts of the processor. For this purpose and as shown in FIG. 22, the present invention provides for a metering blade assembly 5000 that is supported by support assembly 5010. Metering blade assembly 5000 extends from support assembly 5010 toward a first location within drum 14 adjacent to an inside surface of drum 14 as shown in FIGS. 22 and 23. As also shown in FIGS. 22 and 23, metering blade assembly 5000 includes a first arm 5000*a* having a first metering blade 5001*a* extending therefrom, and a second arm 5000*b* having a second metering blade 5001*b* extending therefrom. Metering blade assembly 5000 is designed such that the respective metering blades 5001*a* and 5001*b* are located a predetermined distance from the inside surface of drum 14 so as to not touch the film, but at the same time, are positioned so as to control an amount of processing solution that is provided on the film to be processed while in film path 1520.

Figure 24B:
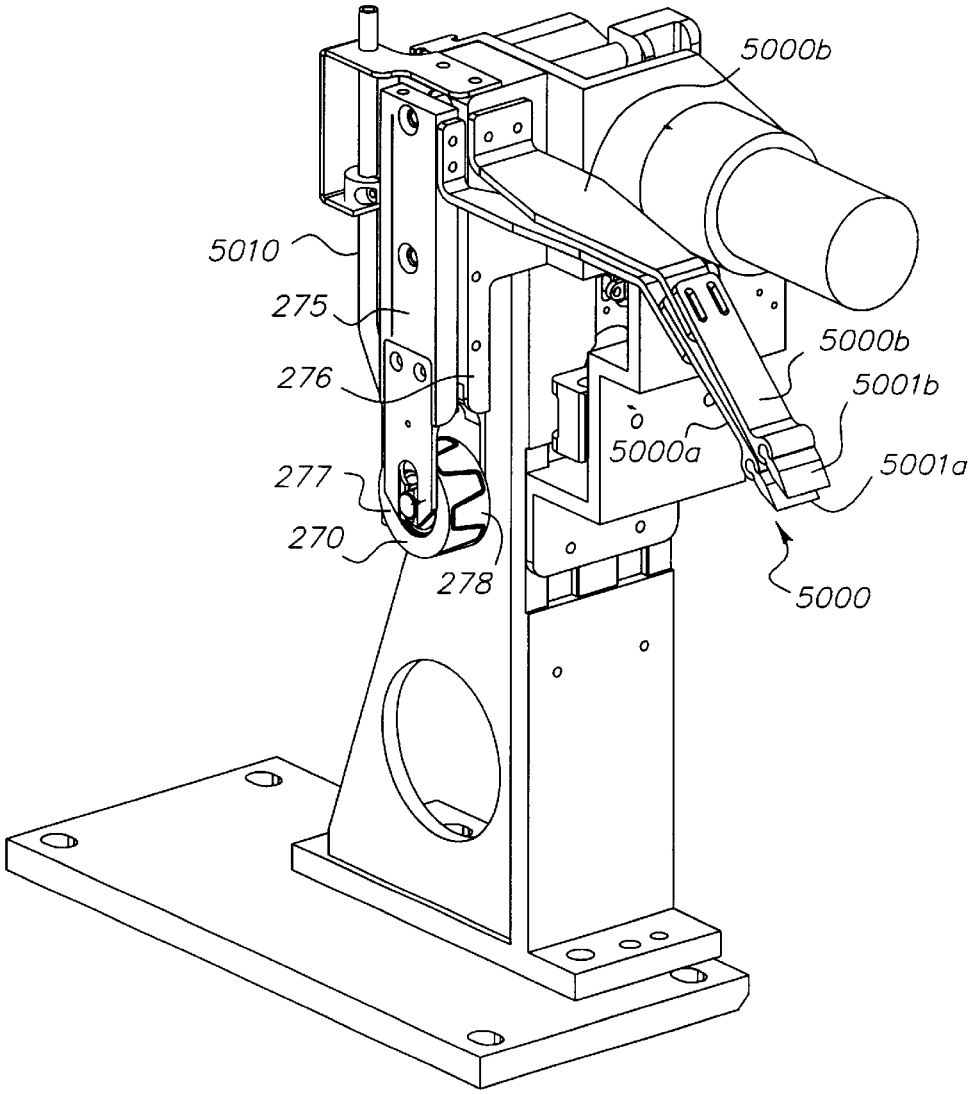
FIG. 24B shows the metering blade of FIG. 24A, as well as an agitating roller adjusted for APS film.

As shown in FIGS. 24A and 24B, a first end of first arm 5000*a* is attached to a first part or more specifically, movable positioning support member 275 of support assembly 5010, and a second end of first arm 5000*a* has first metering blade 5001*a* provided thereon. A first end of second arm 5000*b* is attached to a second part or more specifically, movable positioning member 276 of support assembly 5010, and a second end of second arm 5000*b* has second metering blade 5001*b* provided thereon. As previously described with respect to roller 270, assembly 27 includes motor 271, which provides motion to pistons 272 (see FIG. 25B) which moves first part or member 275 with respect to and/or relative to second part or member 276. This permits roller 270 to be expandable between a first width when the members 277 and 278 overlap each other by a first amount, and a second width larger than the first width, when the members 277 and 278 move away from each other so as to overlap each other by a second amount less than the first amount or not at all.

FIG. 24A and 24B show metering blade assembly 5000 in a first state which is a smaller width state that is used when APS film is being processed in drum 14. More specifically, in the state shown in FIGS. 24A and 24B, at least one of first and second parts or members 275 and 276 is moved a first amount to cause first and second parts 275, 276 to be close to each other. This causes first and second arms 5000*a*, 5000*b* and accordingly, first and second metering blades 5001*a* and 5001*b* to overlap each other by a first amount so as to define a first metering width which is usable for APS film. At the same time, since roller members 277 and 278 are respectively positioned on parts or members 275, 276 of support assembly 5010, agitating roller 270 is also placed in a state in which members 277 and 278 overlap each other by the corresponding first amount and therefore, also define a width suitable for APS film. More specifically, as shown in FIGS. 24A and 24B, both metering blade assembly 5000 and agitating roller 270 are placed in a state which defines a width suitable for APS film.

Figure 25A:
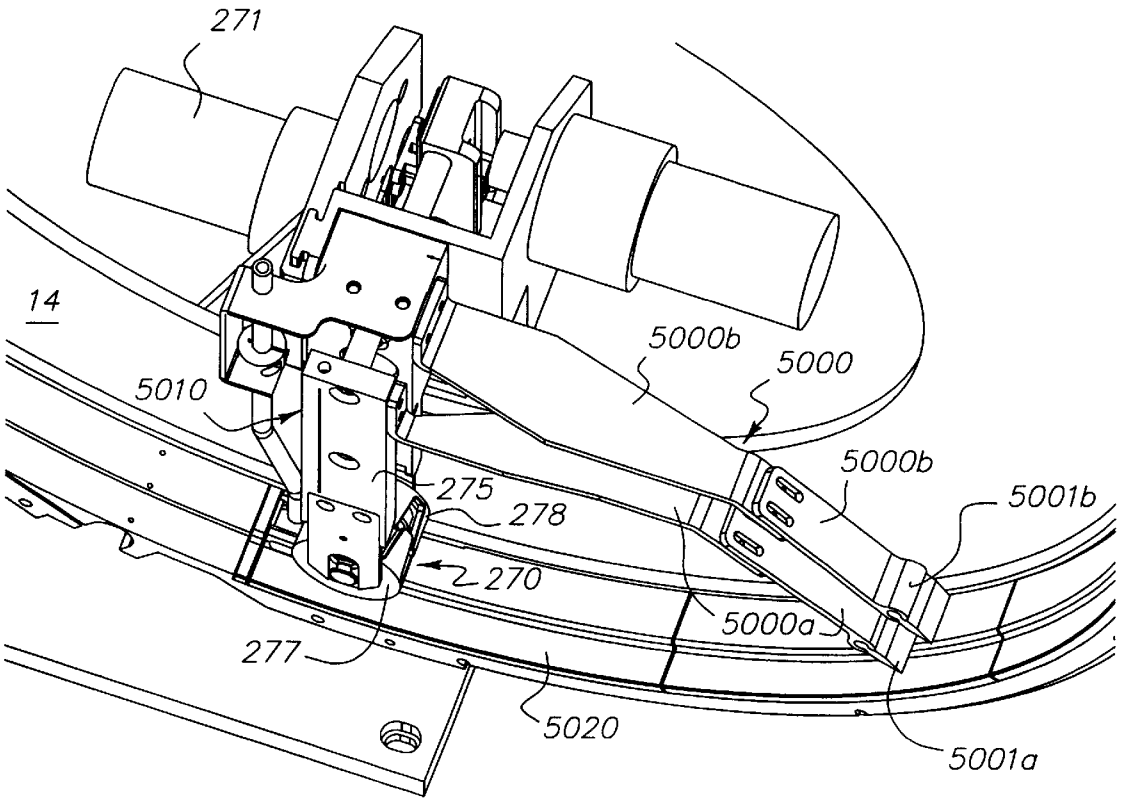
FIG. 25A is a view of the metering blade of FIG. 22, wherein the metering blade is adjusted for 35 mm film.
Figure 25B:
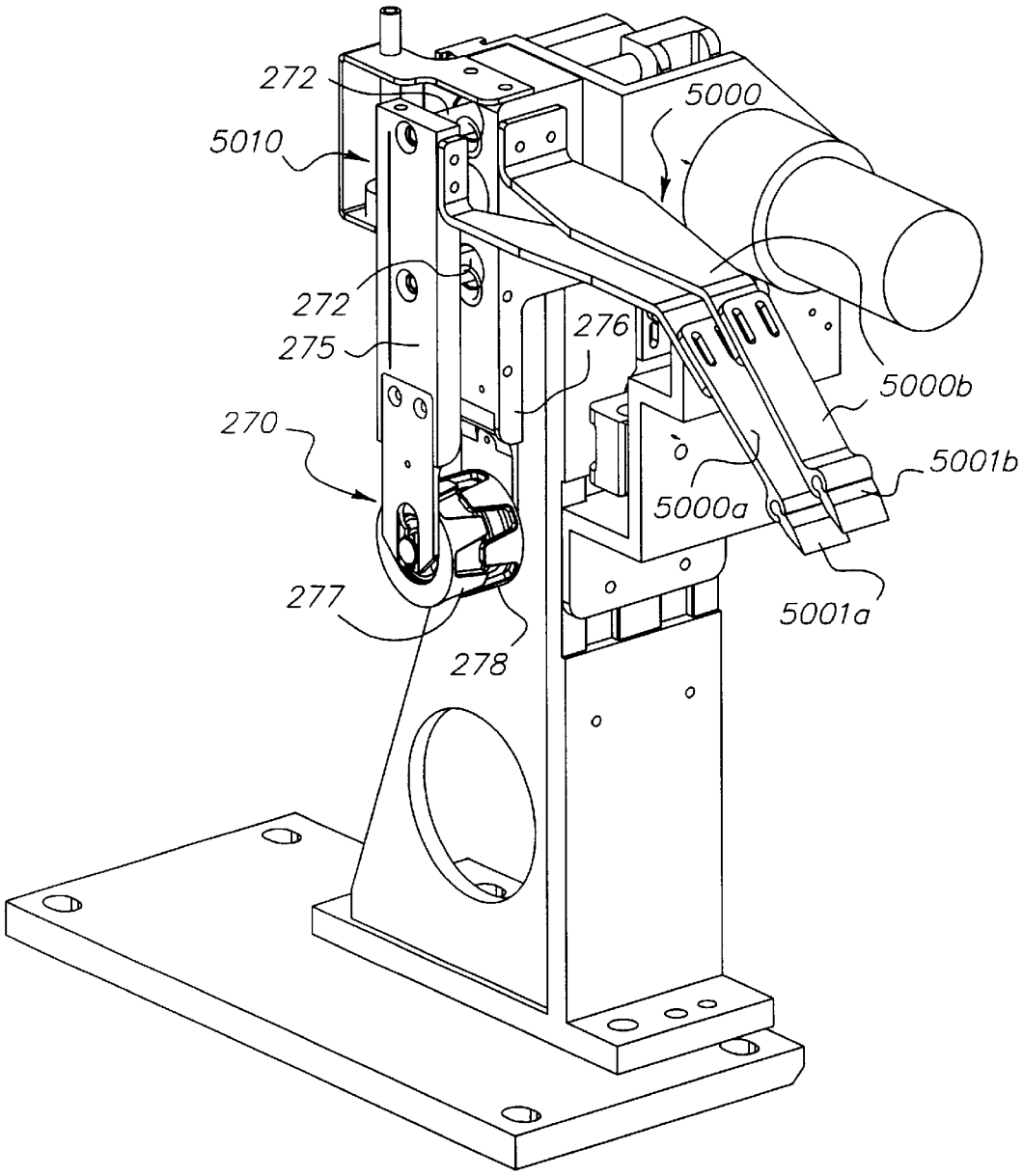
FIG. 25B shows the metering blade of FIG. 25A, as well as an agitating roller adjusted for 35 mm film.

When 35 mm film is being processed in processing drum 14, motor 271 is controllable so as to adjust the positioning of the arms, blades and agitating rollers to a second state which is a larger width state suitable for 35 mm film. As shown in FIG. 25A, support assembly 5010 and more specifically, parts 275 and 276 are controlled to move away from each other. This causes arms 5000*a* and 5000*b* to overlap each other by a minimal or second amount which is less than the first amount or not at all. This additionally causes metering blades 5001*a* and 5001*b* to overlap by the above-noted second amount or not at all to define a metering width suitable for 35 mm film. The movement of parts 275 and 276 causes a corresponding expansion of agitating roller 270 as shown in FIG. 25B, such that agitating roller 270 also has a width which accommodates the width of 35 mm film. More specifically, members 277 and 278 are positioned as shown in FIG. 25B such that they overlap each other by a minimal or second amount or not at all.

With reference to FIG. 23, the positioning of metering blade assembly 5000, support 5010 and agitating roller 270 as shown provides for an area or zone 5025 where it is desired that a maximum amount of processing solution is maintained to assure efficient processing. More specifically, as film passes between roller 270 and the inside surface of drum 14, it is first subject to an agitating action by roller 270 to maximize processing. As the film travels in direction 5030, it passes underneath metering blades 5001*a* and 5001*b* and depending on the type of film that is passing along the film path, the agitating roller and metering blades are either placed in the short width state for APS film (FIG. 24A) or the larger width state for 35 mm film (FIG. 25A). Metering blades 5001*a*, 5001*b* serve to control or meter the amount of solution on the photosensitive film. At the same time, due to the fact that drum 14 is rotated during processing, metering blades 5001*a* and 5001*b* further prevent excess solution from circulating in direction 5030 within processing drum 14 to areas beyond area 5025. This is beneficial in that it assures that other areas of the processor and especially those areas downstream of metering blade assembly 5001*a*, with respect to direction of film travel 5030, do not receive excess solution. This minimizes contamination of other parts of the processor by minimizing contact of these parts with excess circulating solution. This also helps maintain the processing solution within area or zone 5025 to maximize processing. Processing is maximized since the metering assembly 5000 helps maintain the area 5025 which includes an area adjacent to roller 270 wet with processing solution.

Although agitating roller 270 and metering blade assembly 5000 have been described as being adjustable to accommodate the width of 35 mm film and APS film, the present invention is not limited thereto. It is recognized that each of the roller 270 and metering blade assembly 5000 can be adjusted to various widths to accommodate a variety of films in addition to 35 mm and APS film. As an example, roller

270 and metering blade assembly 5000 can be adjusted to also accommodate 120 format and 110 format film.

With respect to metering blades 5001*a*, 5001*b*, the blades can be made of a silicone rubber. However, the invention is not limited thereto, and it is noted that the metering blades can be made of any material which does not cause an adverse reaction within the processing drum with respect to the processing solutions and the photographic material.

The invention has been described in detail with particular reference to certain preferred embodiments thereof, but it will be understood that variations and modifications can be effected within the spirit and scope of the invention.

What is claimed is:

1. A photographic processor comprising:

a circular processing drum for processing photographic film, an inside surface of a perimeter of said drum defining a film path for film to be processed;

a support assembly provided within said circular processing drum; and a metering blade assembly supported by said support assembly, said metering blade assembly extending from said support assembly toward a first location within said drum adjacent to said inside surface of the drum, said metering blade assembly being adapted to at least control an amount of processing solution provided on film to be processed in said film path.

2. A photographic processor according to claim 1, further comprising:

a disk positioned inside the drum and having disk teeth along an outer perimeter of the disk, said disk teeth being capable of interengaging with holes along an edge of the photographic film to be processed to transport the photographic film along the film path in said processing drum.

3. A photographic processor according to claim 1, wherein:

said metering blade assembly comprises a first arm and a second arm;

a first end of said first arm being attached to a first part of said support assembly and a second end of said first arm having a first metering blade provided thereon; and a first end of said second arm being attached to a second part of said support assembly and a second end of said second arm having a second metering blade provided thereon.

4. A photographic processor according to claim 3, wherein:

said first part and said second part of said support assembly are movable with respect to each other to place the metering blade assembly in a first state in which the first and second arms overlap each other by a first amount, to cause said first and second metering blades to overlap each other by said first amount so as to define a first metering width; and said first part and said second part of said support assembly are further movable with respect to each other to place the metering blade assembly in a second state in which the first and second arms overlap each other by a second amount which is less than said first amount or do not overlap each other, to cause said first and second metering blades to overlap each other by said second amont or to not overlap each other so as to define a second metering width which is larger than said first metering width.

5. A photographic processor according to claim 4, wherein said metering blade assembly is placed in said first state when APS film is in said film path and is placed in said second state when 35 mm film is placed in said film path.

6. A photographic processor according to claim 4, further comprising:

an agitating roller assembly supported by said support assembly, said agitating roller assembly comprising a first roller member attached to said first part of said support assembly and a second roller member attached to said second part of said support assembly, such that placement of said metering blade assembly in said first state causes said first roller member and said second roller member to be positioned relative to each other so as to define a first agitating width, and placement of said metering blade assembly in said second state causes said first roller member and said second roller member to be positioned relative to each other so as to define a second agitating width which is greater than said first agitating width.

7. A photographic processor according to claim 6, wherein said first and second roller members are rotatable so as to agitate processing solution as the film in the film path passes between the inside surface of the drum and the first and second roller members.

8. A photographic processor according to claim 1, further comprising:

an agitating roller assembly supported on said support assembly, said agitating roller assembly comprising at least one roller member positioned at a second location within said drum adjacent to said inside surface of said drum, said at least one roller member and said metering blade assembly being adapted to maintain processing solution between said first and second locations.

9. A photographic processor according to claim 1, wherein said metering blade assembly is further adapted to prevent excess processing solution from traveling along said film path passed said first location.

10. A photographic processor comprising:

a circular processing drum which defines a processing chamber for processing photographic film, an inside surface of a perimeter of said drum defining a film path for film to be processed;

support means provided in said processing chamber; and metering means for metering processing solution on said film to be processed, said metering means being supported by said support means.

11. A photographic processor according to claim 10, further comprising:

agitating means for agitating solution as film in said film path passes between said agitating means and said inside surface of the drum.

12. A photographic processor according to claim 10, further comprising:

means for adjusting a width of said metering means between a first width for APS film and a second width for 35 mm film.

13. A photographic processor according to claim 11, further comprising:

means for adjusting a width for both said metering means and said agitating means between a first width for APS film and a second width for 35 mm film.

14. A method for processing photographic film, the method comprising the steps of:

inserting film into a film path in a circular processing drum having processing solution therein, said film path extending along an inside surface of the perimeter of the drum; and providing a metering blade member along said film path to control an amount of processing solution on said film and prevent excess solution from circulating within said processing drum toward an area downstream of said metering member with respect to a direction of travel of said film.

15. A method according to claim 14, further comprising:

agitating the processing solution by way of a rotation of an agitating member provided in said processing drum as the film to be processed travels along the film path, said agitating member being located upstream of said metering member with respect to the direction of travel of the film.

16. A method according to claim 14, further comprising:

adjusting a width of said metering blade member in accordance with a type of film to be processed.

17. A method according to claim 15, further comprising:

adjusting a width of both said metering blade member and said agitating member in accordance with a type of film to be processed.

* * * * *